US011488437B2

(12) United States Patent
Acres

(10) Patent No.: US 11,488,437 B2
(45) **Date of Patent: *Nov. 1, 2022**

(54) MEANS FOR CONTROLLING PAYBACK PERCENTAGE OF GAMING DEVICE

(71) Applicant: Acres Technology, Las Vegas, NV (US)

(72) Inventor: John F. Acres, Las Vegas, NV (US)

(73) Assignee: ACRES TECHNOLOGY, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/314,298

(22) Filed: May 7, 2021

(65) Prior Publication Data

US 2021/0264717 A1 Aug. 26, 2021

Related U.S. Application Data

(60) Continuation of application No. 15/622,903, filed on Jun. 14, 2017, now Pat. No. 11,017,626, which is a (Continued)

(51) Int. Cl.
*G07F 17/32* (2006.01)
*G07F 17/34* (2006.01)

(52) U.S. Cl.
CPC ..... *G07F 17/3202* (2013.01); *G07F 17/34* (2013.01); *G07F 17/32* (2013.01); (Continued)

(58) Field of Classification Search
CPC . G07F 17/3244; G07F 17/326; G07F 17/3267 (Continued)

(56) References Cited

U.S. PATENT DOCUMENTS 2,669,389 A 2/1954 Mesi et al.
3,124,355 A 3/1964 Mentzer
(Continued)

FOREIGN PATENT DOCUMENTS

EP 141264 5/1985
EP 896304 2/1999
(Continued)

OTHER PUBLICATIONS

"White Paper: An Analysis of Harrah's Total Rewards Program" written and published by Gaming Market Advisor on or before Dec. 31, 2006, retreived URL <http://www.gamingmarketadvisors.com/publications/Harrahs%20Total%20Reward%20White%20Paper.pdf>, 41 pages.

(Continued)

*Primary Examiner* — Chase E Leichliter
(74) *Attorney, Agent, or Firm* — Ballard Spahr LLP

(57) ABSTRACT

Embodiments of the present concept provide means to control the payback percentage of games being played on gaming devices. In one example, a gaming device includes a processor configured to initiate a payback-controlling event and determine a game outcome to display on the game display in response to a gaming event being initiated. Here, the determined game outcome is a payback-controlling outcome when the payback-controlling event satisfies the payback-controlling criterion, and the determined game outcome is a game outcome determined from the base-game paytable when the payback-controlling event does not satisfy the payback-controlling criterion.

12 Claims, 9 Drawing Sheets

Related U.S. Application Data division of application No. 12/980,990, filed on Dec. 29, 2010, now Pat. No. 9,704,331.

(52) U.S. Cl.
CPC ..... *G07F 17/326* (2013.01); *G07F 17/3244* (2013.01); *G07F 17/3267* (2013.01)

(58) Field of Classification Search
USPC ..... 463/20
See application file for complete search history.

(56) References Cited

U.S. PATENT DOCUMENTS 3,124,674 A 3/1964 Edwards
3,684,290 A 8/1972 Wayne
3,727,213 A 4/1973 Kurtenbach
3,751,040 A 8/1973 Carey
4,254,404 A 3/1981 White
4,433,844 A 2/1984 Hooker et al.
4,669,731 A 6/1987 Clarke
4,836,546 A 6/1989 DiRe
4,887,813 A 12/1989 Chiles, III et al.
5,022,653 A 6/1991 Suttle et al.
5,024,439 A 6/1991 Okada
5,027,102 A 6/1991 Sweeny
5,031,914 A 7/1991 Rosenthal
5,078,405 A 1/1992 Jones et al.
5,152,529 A 10/1992 Okada
5,178,395 A 1/1993 Lovell
5,221,083 A 6/1993 Dote
5,265,880 A 11/1993 Maksymec
5,342,049 A 8/1994 Wichinsky et al.
5,364,104 A 11/1994 Jones et al.
5,377,973 A 1/1995 Jones et al.
5,380,008 A * 1/1995 Mathis ..... G07F 17/3262 463/20
5,490,670 A 2/1996 Hobert
5,536,016 A 7/1996 Thompson
5,564,700 A 10/1996 Celona
5,584,485 A 12/1996 Jones et al.
5,586,766 A 12/1996 Forte et al.
5,655,961 A 8/1997 Acres et al.
5,674,128 A 10/1997 Holch et al.
5,695,402 A 12/1997 Stupak
5,697,844 A 12/1997 Kohorn
5,743,798 A 4/1998 Adams et al.
5,758,875 A 6/1998 Giacalone, Jr.
5,766,076 A 6/1998 Pease et al.
5,816,918 A 10/1998 Kelly et al.
5,830,064 A 11/1998 Bradish et al.
5,836,816 A 11/1998 Bruin et al.
5,836,817 A 11/1998 Acres et al.
5,851,147 A 12/1998 Stupak et al.
5,913,726 A 6/1999 Jones et al.
5,934,998 A 8/1999 Forte et al.
5,941,770 A 8/1999 Miers et al.
5,960,406 A 9/1999 Rasansky et al.
5,984,779 A 11/1999 Bridgeman et al.
6,003,013 A 12/1999 Boushy et al.
6,012,983 A 1/2000 Walker et al.
6,024,642 A 2/2000 Stupak
6,030,109 A 2/2000 Lobsenz
6,032,955 A 3/2000 Luciano et al.
6,045,130 A 4/2000 Jones et al.
6,048,272 A 4/2000 Tsujita
6,059,659 A 5/2000 Busch et al.
6,077,163 A 6/2000 Walker et al.
6,086,477 A 7/2000 Walker et al.
6,106,395 A 8/2000 Begis
6,110,041 A 8/2000 Walker et al.
6,110,043 A 8/2000 Olsen
6,135,884 A 10/2000 Hedrick et al.
6,146,273 A 11/2000 Olsen
6,165,071 A 12/2000 Weiss
6,168,521 B1 1/2001 Luciano et al.
6,183,362 B1 2/2001 Boushy
6,186,893 B1 2/2001 Walker et al.
6,196,918 B1 3/2001 Miers et al.
6,217,448 B1 4/2001 Olsen
6,224,482 B1 5/2001 Bennet
6,234,900 B1 5/2001 Cumbers
6,254,483 B1 7/2001 Acres
6,264,560 B1 7/2001 Goldberg et al.
6,289,382 B1 9/2001 Bowman-Amuah
6,293,866 B1 9/2001 Walker et al.
6,293,868 B1 9/2001 Bernard
6,302,793 B1 10/2001 Fertitta, III et al.
6,315,662 B1 11/2001 Jorasch et al.
6,315,666 B1 11/2001 Mastera et al.
6,319,122 B1 11/2001 Packes et al.
6,319,125 B1 11/2001 Acres
6,186,892 B1 12/2001 Frank et al.
6,336,859 B2 1/2002 Jones et al.
6,347,996 B1 2/2002 Gilmore et al.
6,364,314 B1 4/2002 Canterbury
6,364,768 B1 4/2002 Acres et al.
6,368,216 B1 4/2002 Hedrick et al.
6,371,852 B1 4/2002 Acres
6,425,823 B1 7/2002 Byrne
6,428,002 B1 8/2002 Baranauskas
6,443,456 B1 9/2002 Gajor
6,454,648 B1 9/2002 Kelly et al.
6,457,045 B1 9/2002 Hanson et al.
6,471,588 B2 10/2002 Sakamoto
6,485,367 B1 11/2002 Joshi
6,485,368 B2 11/2002 Jones et al.
6,520,856 B1 2/2003 Walker et al.
6,565,434 B1 5/2003 Acres
6,565,436 B1 5/2003 Baerlocher
6,569,013 B1 5/2003 Taylor
6,575,832 B1 6/2003 Manfredi et al.
6,592,457 B1 7/2003 Frohm et al.
6,599,186 B1 7/2003 Walker et al.
6,606,615 B1 8/2003 Jennings et al.
6,620,046 B2 8/2003 Rowe
6,634,922 B1 10/2003 Driscoll et al.
6,648,757 B1 11/2003 Slomiany et al.
6,652,378 B2 11/2003 Cannon et al.
6,656,047 B1 12/2003 Tarantino et al.
6,695,700 B2 2/2004 Walker et al.
6,697,165 B2 2/2004 Wakai et al.
6,702,670 B2 3/2004 Jasper et al.
6,709,331 B2 3/2004 Berman
6,712,693 B1 3/2004 Hettinger
6,712,695 B2 3/2004 Mothwurf et al.
6,722,985 B2 4/2004 Criss-Puszkiewicz et al.
6,749,510 B2 6/2004 Giobbi
6,751,657 B1 6/2004 Zothner
6,755,420 B2 6/2004 Colton
6,758,754 B1 7/2004 Lavanchy et al.
6,760,595 B2 7/2004 Inselberg
6,780,104 B2 8/2004 Fox
6,786,824 B2 9/2004 Cannon
6,800,026 B2 10/2004 Cannon
6,800,027 B2 10/2004 Giobbi et al.
6,802,778 B1 10/2004 Lemay et al.
6,811,482 B2 11/2004 Letovsky
6,811,486 B1 11/2004 Luciano, Jr.
6,860,808 B2 3/2005 Levitan
6,860,810 B2 3/2005 Cannon et al.
6,939,227 B2 9/2005 Jorasch et al.
6,944,509 B2 9/2005 Altmaier et al.
6,948,171 B2 9/2005 Dan et al.
6,965,868 B1 11/2005 Bednarek
6,973,665 B2 12/2005 Dudkiewicz et al.
RE38,982 E 2/2006 Forte et al.
6,997,380 B2 2/2006 Safaei et al.
6,998,806 B2 2/2006 Suzuki
7,037,195 B2 5/2006 Schneider et al.
7,048,628 B2 5/2006 Schneider
7,056,210 B2 6/2006 Bansemer et al.
7,069,232 B1 6/2006 Fox et al.
7,090,579 B2 8/2006 Tarantino

(56) References Cited

U.S. PATENT DOCUMENTS 7,094,149 B2 8/2006 Walker et al.
7,094,150 B2 8/2006 Ungaro et al.
7,103,560 B1 9/2006 Fox et al.
7,131,908 B2 11/2006 Baerlocher
7,144,322 B2 12/2006 Gomez et al.
7,160,189 B2 1/2007 Walker et al.
7,169,052 B2 1/2007 Beaulieu et al.
7,175,521 B2 2/2007 McClintic
7,182,690 B2 2/2007 Giobbo et al.
7,184,965 B2 2/2007 Fox et al.
7,186,181 B2 3/2007 Rowe
7,192,346 B2 3/2007 Mathis
7,195,243 B2 3/2007 Kenny et al.
7,201,654 B1 4/2007 Jarvis et al.
7,251,805 B2 7/2007 Koo
7,329,185 B2 2/2008 Conover et al.
7,338,372 B2 3/2008 Morrow et al.
7,361,089 B2 4/2008 Daly et al.
7,374,486 B2 5/2008 Baerlocher
7,410,422 B2 8/2008 Fine
7,416,186 B2 8/2008 Walker et al.
7,458,892 B2 12/2008 Walker et al.
7,594,851 B2 9/2009 Falconer
7,628,691 B2 12/2009 Luciano et al.
7,674,180 B2 3/2010 Graham et al.
7,704,137 B2 4/2010 Englman
7,717,788 B2 5/2010 Rowe
7,765,121 B2 7/2010 Pace et al.
7,775,876 B2 8/2010 Rowe
7,811,167 B2 10/2010 Giobbi et al.
7,846,018 B2 12/2010 Baerlocher
7,857,693 B1 12/2010 Johnson et al.
7,963,844 B2 6/2011 Walker et al.
8,052,517 B2 11/2011 Manfredi et al.
8,062,124 B2 11/2011 Jaffe
RE43,037 E * 12/2011 Walker ..... G07F 17/3244 273/237
8,545,319 B2 * 10/2013 Kaneko ..... G07F 17/32 463/31
9,704,331 B2 * 7/2017 Acres ..... G07F 17/34
11,017,626 B2 * 5/2021 Acres ..... G07F 17/3202
2001/0004609 A1 6/2001 Walker et al.
2001/0024015 A1 9/2001 Hogan et al.
2001/0046893 A1 11/2001 Giobbi et al.
2001/0048193 A1 12/2001 Yoseloff et al.
2002/0013173 A1 1/2002 Walker et al.
2002/0016202 A1 2/2002 Fertitta et al.
2002/0019253 A1 2/2002 Reitzen et al.
2002/0032052 A1 3/2002 Levitan
2002/0034981 A1 3/2002 Hisada
2002/0039923 A1 4/2002 Cannon et al.
2002/0055381 A1 5/2002 Tarantino
2002/0058545 A1 5/2002 Luciano
2002/0086726 A1 7/2002 Ainsworth
2002/0094855 A1 7/2002 Berman
2002/0103018 A1 8/2002 Rommerdahl et al.
2002/0107072 A1 8/2002 Giobbi
2002/0143652 A1 8/2002 Beckett
2002/0123376 A1 9/2002 Walker et al.
2002/0132664 A1 9/2002 Miller et al.
2002/0142825 A1 10/2002 Lark et al.
2002/0147040 A1 10/2002 Walker et al.
2002/0147043 A1 10/2002 Shulman et al.
2002/0152120 A1 10/2002 Howington
2002/0167126 A1 11/2002 De Raedt et al.
2002/0177480 A1 11/2002 Rowe
2002/0177483 A1 11/2002 Cannon
2002/0187834 A1 12/2002 Rowe et al.
2002/0193162 A1 12/2002 Walker et al.
2003/0003989 A1 1/2003 Johnson
2003/0013512 A1 1/2003 Rowe
2003/0013516 A1 1/2003 Walker et al.
2003/0017865 A1 1/2003 Beaulieu et al.
2003/0032474 A1 2/2003 Kaminkow
2003/0036425 A1 2/2003 Kaminkow et al.
2003/0054878 A1 3/2003 Benoy et al.
2003/0054881 A1 3/2003 Hedrick et al.
2003/0064769 A1 4/2003 Muir
2003/0064771 A1 4/2003 Morrow et al.
2003/0067116 A1 4/2003 Colton
2003/0078101 A1 4/2003 Schneider et al.
2003/0083943 A1 5/2003 Adams et al.
2003/0087685 A1 5/2003 Hogan et al.
2003/0092484 A1 5/2003 Schneider et al.
2003/0100360 A1 5/2003 Manfredi et al.
2003/0114217 A1 6/2003 Walker et al.
2003/0119575 A1 6/2003 Centouri et al.
2003/0135304 A1 7/2003 Sroub et al.
2003/0144048 A1 7/2003 Silva
2003/0178774 A1 9/2003 Marcilio
2003/0186733 A1 10/2003 Wolf et al.
2003/0187736 A1 10/2003 Teague et al.
2003/0190944 A1 10/2003 Manfredi et al.
2003/0195029 A1 10/2003 Frohm et al.
2003/0199295 A1 10/2003 Vancura
2003/0199312 A1 10/2003 Walker et al.
2003/0204474 A1 10/2003 Capek et al.
2003/0110139 A1 11/2003 Peterson
2003/0209853 A1 11/2003 Harris
2003/0211884 A1 11/2003 Gauselmann
2003/0216169 A1 11/2003 Walker et al.
2003/0220138 A1 11/2003 Walker et al.
2003/0220143 A1 11/2003 Shteyn et al.
2003/0228901 A1 12/2003 Walker et al.
2003/0232640 A1 12/2003 Walker et al.
2003/0234489 A1 12/2003 Okada
2003/0236110 A1 12/2003 Beaulieu et al.
2004/0002377 A1 * 1/2004 Staw ..... G07F 17/3244 463/25
2004/0009808 A1 1/2004 Gauselmann
2004/0029631 A1 * 2/2004 Duhamel ..... G07F 17/3267 463/20
2004/0038732 A1 * 2/2004 Vancura ..... G07F 17/3227 463/25
2004/0038735 A1 2/2004 Steil et al.
2004/0038736 A1 2/2004 Bryant et al.
2004/0048650 A1 3/2004 Mierau et al.
2004/0053657 A1 3/2004 Fiden et al.
2004/0053681 A1 3/2004 Jordan et al.
2004/0063484 A1 4/2004 Dreaper et al.
2004/0072609 A1 4/2004 Ungaro et al.
2004/0103013 A1 5/2004 Jameson
2004/0121833 A1 6/2004 Mezen et al.
2004/0142742 A1 7/2004 Schneider et al.
2004/0158536 A1 8/2004 Kowal et al.
2004/0166940 A1 8/2004 Rothschild
2004/0180722 A1 9/2004 Giobbi
2004/0185932 A1 * 9/2004 Lombardo ..... G07F 17/3262 463/21
2004/0198485 A1 10/2004 Loose et al.
2004/0203611 A1 10/2004 Laporta et al.
2004/0204213 A1 10/2004 Schugar et al.
2004/0204216 A1 10/2004 Schugar
2004/0204222 A1 10/2004 Roberts
2004/0219967 A1 11/2004 Giobbi et al.
2004/0224750 A1 11/2004 Al-Ziyoud
2004/0229671 A1 11/2004 Stronach et al.
2004/0229683 A1 11/2004 Mothwurf et al.
2004/0229700 A1 11/2004 Cannon et al.
2004/0235542 A1 11/2004 Stronach et al.
2004/0242313 A1 * 12/2004 Munoz ..... G07F 17/3262 463/20
2004/0248642 A1 12/2004 Rothschild
2004/0254010 A1 12/2004 Fine
2005/0014558 A1 1/2005 Estey
2005/0026674 A1 2/2005 Wolf et al.
2005/0043072 A1 2/2005 Nelson
2005/0043088 A1 2/2005 Nguyen et al.
2005/0043092 A1 2/2005 Gauselmann
2005/0043094 A1 2/2005 Nguyen et al.
2005/0049028 A1 3/2005 Gomez et al.
2005/0054438 A1 3/2005 Rothschild et al.
2005/0059467 A1 3/2005 Saffari et al.
2005/0070356 A1 3/2005 Mothwurf et al.

(56) References Cited

U.S. PATENT DOCUMENTS

2005/0075164 A1 4/2005 Krynicky
2005/0096121 A1 5/2005 Gilliland et al.
2005/0096124 A1 5/2005 Stronach
2005/0101375 A1 5/2005 Webb et al.
2005/0101379 A1 5/2005 Falconer
2005/0119052 A1 6/2005 Russell et al.
2005/0124415 A1 6/2005 Centuori et al.
2005/0148380 A1 7/2005 Cannon et al.
2005/0148383 A1 7/2005 Mayeroff
2005/0153773 A1 7/2005 Nguyen et al.
2005/0164764 A1 7/2005 Ghaly
2005/0181856 A1 8/2005 Cannon et al.
2005/0181860 A1 8/2005 Nguyen et al.
2005/0181862 A1 8/2005 Asher et al.
2005/0187014 A1 8/2005 Saffari et al.
2005/0192080 A1 9/2005 Cote et al.
2005/0208995 A1 9/2005 Marshall et al.
2005/0215311 A1 9/2005 Hornik et al.
2005/0215316 A1 9/2005 Rowe et al.
2005/0233794 A1 10/2005 Cannon et al.
2005/0239541 A1 10/2005 Jorasch et al.
2005/0239545 A1 10/2005 Rowe
2005/0251440 A1 11/2005 Bednarek
2005/0255902 A1 11/2005 Lind
2005/0266905 A1 12/2005 Emori et al.
2006/0009284 A1 1/2006 Schwartz et al.
2006/0025207 A1 2/2006 Walker et al.
2006/0030391 A1 2/2006 Casey et al.
2006/0030400 A1 2/2006 Mathis
2006/0040723 A1 2/2006 Baerlocher et al.
2006/0040730 A1 2/2006 Walker et al.
2006/0046830 A1 3/2006 Webb
2006/0046835 A1 3/2006 Walker et al.
2006/0052160 A1 3/2006 Saffari et al.
2006/0058095 A1 3/2006 Berman et al.
2006/0058097 A1 3/2006 Berman et al.
2006/0068898 A1 3/2006 Maya
2006/0068899 A1 3/2006 White et al.
2006/0068903 A1 3/2006 Walker et al.
2006/0073872 A1 4/2006 B-Jensen et al.
2006/0073887 A1 4/2006 Nguyen et al.
2006/0079310 A1 4/2006 Friedman et al.
2006/0079314 A1 4/2006 Walker et al.
2006/0084496 A1 4/2006 Jaffe et al.
2006/0094493 A1 5/2006 Kido
2006/0100009 A1 5/2006 Walker et al.
2006/0105836 A1 5/2006 Walker et al.
2006/0189378 A1 5/2006 Aoki
2006/0116201 A1 6/2006 Gauselmann
2006/0121972 A1 6/2006 Walker et al.
2006/0121981 A1 6/2006 Pfenninghausen et al.
2006/0128467 A1 6/2006 Thomas
2006/0135249 A1 6/2006 Seelig et al.
2006/0148559 A1 7/2006 Jordan et al.
2006/0149632 A1 7/2006 Register et al.
2006/0154714 A1 7/2006 Montross et al.
2006/0174270 A1 8/2006 Westberg et al.
2006/0183536 A1 8/2006 Gagner et al.
2006/0199631 A1 9/2006 McGill et al.
2006/0205483 A1 9/2006 Meyer et al.
2006/0211479 A1* 9/2006 Walker ..... G07F 17/32 463/16
2006/0211486 A1 9/2006 Walker et al.
2006/0217175 A1 9/2006 Walker et al.
2006/0229127 A1 10/2006 Walker et al.
2006/0247041 A1 11/2006 Walker et al.
2006/0252510 A1 11/2006 Walker et al.
2006/0252512 A1 11/2006 Walker et al.
2006/0252516 A1 11/2006 Walker et al.
2006/0258422 A1* 11/2006 Walker ..... G07F 17/32 463/7
2006/0258425 A1 11/2006 Edidin et al.
2006/0258432 A1 11/2006 Packer et al.
2006/0287045 A1 12/2006 Walker et al.
2006/0287098 A1 12/2006 Morrow et al.
2006/0287102 A1 12/2006 White et al.
2007/0001396 A1 1/2007 Walker et al.
2007/0010309 A1 1/2007 Giobbi et al.
2007/0010315 A1 1/2007 Hein
2007/0050256 A1 3/2007 Walker et al.
2007/0060252 A1 3/2007 Taylor
2007/0060274 A1 3/2007 Rowe et al.
2007/0060323 A1 3/2007 Isaac et al.
2007/0060387 A1 3/2007 Enzminger et al.
2007/0087806 A1 4/2007 Luciano et al.
2007/0105615 A1 5/2007 Lind
2007/0105618 A1 5/2007 Steil
2007/0111776 A1 5/2007 Griswold et al.
2007/0112609 A1 5/2007 Howard et al.
2007/0117619 A1 5/2007 Walker et al.
2007/0117623 A1 5/2007 Nelson et al.
2007/0129147 A1 6/2007 Gagner
2007/0135214 A1 6/2007 Walker et al.
2007/0143156 A1 6/2007 van Deursen
2007/0167210 A1 7/2007 Kelly et al.
2007/0184897 A1 8/2007 Fujimoto
2007/0191087 A1 8/2007 Thomas et al.
2007/0197247 A1 8/2007 Inselberg
2007/0205556 A1 9/2007 Roemer et al.
2007/0259709 A1 11/2007 Kelly et al.
2007/0275777 A1 11/2007 Walker et al.
2007/0293302 A1* 12/2007 Lind ..... G07F 17/32 463/25
2008/0015004 A1 1/2008 Gatto et al.
2008/0032759 A1* 2/2008 Takahashi ..... A63F 13/795 463/1
2008/0039190 A1 2/2008 Walker et al.
2008/0058105 A1 3/2008 Combs et al.
2008/0064495 A1 3/2008 Bryant et al.
2008/0076576 A1 3/2008 Graham et al.
2008/0090651 A1 4/2008 Baerlocher
2008/0096636 A1 4/2008 Power
2008/0102935 A1 5/2008 Finnimore
2008/0113744 A1 5/2008 Whitcher
2008/0113749 A1 5/2008 Williams et al.
2008/0113777 A1 5/2008 Anderson
2008/0113779 A1 5/2008 Cregan
2008/0113811 A1 5/2008 Linard et al.
2008/0132320 A1 6/2008 Rodgers
2008/0146331 A1 6/2008 Nordman et al.
2008/0182655 A1 7/2008 DeWaal et al.
2008/0214300 A1* 9/2008 Williams ..... H04L 67/34 463/29
2008/0220840 A1* 9/2008 Katz ..... G07F 17/329 463/16
2008/0220861 A1 9/2008 Okada
2008/0234035 A1 9/2008 Malek
2008/0242394 A1 10/2008 Sakuma
2008/0242398 A1 10/2008 Harris et al.
2008/0248851 A1 10/2008 Bloom
2008/0254886 A1 10/2008 Kelly
2008/0261699 A1 10/2008 Topham et al.
2008/0268959 A1 10/2008 Bryson et al.
2008/0280674 A1 11/2008 Sakuma
2008/0287186 A1 11/2008 Sakuma
2008/0293467 A1 11/2008 Mathis
2008/0311973 A1 12/2008 Jaffe
2008/0318656 A1 12/2008 Walker et al.
2009/0005170 A9 1/2009 Kelly et al.
2009/0036202 A1 2/2009 Baerlocher et al.
2009/0042652 A1* 2/2009 Baerlocher ..... G07F 17/34 463/20
2009/0070081 A1 3/2009 Saenz et al.
2009/0088239 A1* 4/2009 Iddings ..... G07F 17/3244 463/43
2009/0088252 A1* 4/2009 Nicely ..... G07F 17/3286 463/42
2009/0117981 A1 5/2009 Yoshizawa
2009/0118005 A1 5/2009 Kelly et al.
2009/0124364 A1 5/2009 Cuddy et al.
2009/0131175 A1 5/2009 Kelly et al.
2009/0170608 A1* 7/2009 Herrmann ..... G07F 17/3237 463/42

(56) References Cited

U.S. PATENT DOCUMENTS

| | | | | |
|---|---|---|---|---|
| 2009/0233682 | A1 | 9/2009 | Kato et al. | |
| 2009/0239601 | A1 | 9/2009 | Macke | |
| 2009/0247284 | A1 | 10/2009 | Sugiyama et al. | |
| 2009/0253478 | A1 | 10/2009 | Walker et al. | |
| 2009/0253490 | A1 | 10/2009 | Teranishi | |
| 2009/0258693 | A1 | 10/2009 | Preston | |
| 2009/0270168 | A1 | 10/2009 | Englman et al. | |
| 2009/0325669 | A1 | 12/2009 | Kelly et al. | |
| 2009/0325670 | A1 | 12/2009 | Kelly et al. | |
| 2010/0016055 | A1 | 1/2010 | Englman | |
| 2010/0041464 | A1 | 2/2010 | Arezina et al. | |
| 2010/0056248 | A1 | 3/2010 | Acres | |
| 2010/0056259 | A1* | 3/2010 | Okada | G07F 17/32 463/25 |
| 2010/0075741 | A1 | 3/2010 | Aoki et al. | |
| 2010/0124988 | A1 | 5/2010 | Amos et al. | |
| 2010/0210338 | A1* | 8/2010 | Taylor | G07F 17/3244 463/16 |
| 2010/0210342 | A1* | 8/2010 | Pollack | G07F 17/3244 463/20 |
| 2010/0285867 | A1 | 11/2010 | Okada | |
| 2011/0009177 | A1* | 1/2011 | Katz | G07F 17/3241 463/25 |
| 2011/0039615 | A1 | 2/2011 | Acres | |
| 2011/0077067 | A1* | 3/2011 | Ellis | G07F 17/32 463/16 |
| 2011/0081958 | A1 | 4/2011 | Hermann et al. | |
| 2011/0159950 | A1* | 6/2011 | Okada | G07F 17/3267 463/25 |
| 2011/0275438 | A9 | 11/2011 | Hardy et al. | |
| 2011/0281632 | A1 | 11/2011 | Okada | |
| 2011/0294563 | A1 | 12/2011 | Jaffe | |
| 2012/0077565 | A1 | 3/2012 | Barbalet | |
| 2012/0108337 | A1 | 5/2012 | Kelly et al. | |
| 2012/0115566 | A1 | 5/2012 | Fujisawa et al. | |
| 2012/0122558 | A1 | 5/2012 | Lyons et al. | |
| 2012/0135800 | A1 | 5/2012 | Acres | |
| 2012/0172107 | A1* | 7/2012 | Acres | G07F 17/34 463/16 |
| 2012/0172108 | A1 | 7/2012 | Acres | |
| 2012/0172130 | A1 | 7/2012 | Acres | |
| 2012/0190425 | A1 | 7/2012 | Barbelet | |
| 2017/0287288 | A1* | 10/2017 | Acres | G07F 17/3202 |
| 2021/0264717 | A1* | 8/2021 | Acres | G07F 17/34 |

FOREIGN PATENT DOCUMENTS

| | | |
|---|---|---|
| EP | 896308 | 2/1999 |
| EP | 919965 | 6/1999 |
| EP | 981397 | 3/2000 |
| EP | 1091789 | 4/2001 |
| EP | 1231577 | 8/2002 |
| EP | 1351180 | 10/2003 |
| EP | 1369830 | 12/2003 |
| EP | 1490849 | 12/2004 |
| EP | 1496419 | 1/2005 |
| EP | 1623375 | 2/2006 |
| EP | 1637196 | 3/2006 |
| EP | 1832952 | 9/2007 |
| JP | 2-21883 | 1/1990 |
| WO | 95/21665 | 8/1995 |
| WO | 95/31262 | 11/1995 |
| WO | 96/35490 | 11/1995 |
| WO | 97/46293 | 12/1997 |
| WO | 00/17825 | 3/2000 |
| WO | 00/32286 | 6/2000 |
| WO | 00/64545 | 11/2000 |
| WO | 01/36059 | 5/2001 |
| WO | 01/59680 | 8/2001 |
| WO | 01/80961 | 11/2001 |
| WO | 03/066179 | 8/2003 |
| WO | 03/089092 | 10/2003 |
| WO | 2005/029279 | 3/2005 |
| WO | 2005/029287 | 3/2005 |
| WO | 2005/099845 | 10/2005 |
| WO | 2005/113093 | 12/2005 |
| WO | 2006/014745 | 2/2006 |
| WO | 2006/014770 | 2/2006 |
| WO | 2006/014990 | 2/2006 |
| WO | 2006/032498 | 3/2006 |
| WO | 2006/036948 | 4/2006 |
| WO | 2006/055518 | 5/2006 |
| WO | 2006/060442 | 6/2006 |
| WO | 2006/060493 | 6/2006 |
| WO | 2007/087286 | 8/2007 |
| WO | 2008/024705 | 2/2008 |

OTHER PUBLICATIONS

Acres, John, An Ingenious Internet Marketing Tool, Slot Operations Management / Casino Enterprise Management, Aug. 2007, pp. 8-10.

Acres, John, Measuring the Player Experience: What a Squiggly Line Can Tell You, Inside Edge / Slot Manager, January / February, pp. 28-29.

Acres, John, The Future of Gaming, Where Will You be in 10 Years? Slot Operations Management, / Casino Enterprise Management, Jul. 2007, pp. 8-10, 12.

* cited by examiner

MEANS FOR CONTROLLING PAYBACK PERCENTAGE OF GAMING DEVICE

RELATED APPLICATIONS

This application is a continuation of U.S. patent application Ser. No. 15/622,903 filed on Jun. 14, 2017, which is a divisional of and claims priority to U.S. patent application Ser. No. 12/980,990 filed on Dec. 29, 2010, now U.S. Pat. No. 9,704,331 issued on Jul. 11, 2017, which are incorporated herein by reference in their entirety.

This application is related to the following U.S. patent applications: U.S. patent application Ser. No. 12/981,048, filed Dec. 29, 2010, entitled EVENT-BASED GAMING OPERATION FOR GAMING DEVICE and U.S. patent application Ser. No. 12/981,091, filed Dec. 29, 2010, entitled MEANS FOR ENHANCING GAME PLAY OF GAMING DEVICE. The disclosures of the above-listed applications are incorporated herein by reference in their entirety for all purposes.

FIELD OF THE INVENTION

This disclosure relates generally to gaming devices, and more particularly to gaming devices and gaming systems that are configured to control the payback percentage of games being played on the gaming devices.

BACKGROUND

Game outcomes on gaming devices are typically determined at random where winning outcomes are awarded to a player in the form of money, credits, promotions, prizes, or other incentives, and losing outcomes typically result only in a lost wager. Player excitement is typically generated by providing the possibility of winning large awards for a relatively meager wager. Indeed, for most players, the excitement and gratification of gambling is tied to achieving wins. While these players will endure certain periods of loss, players will often press the spin and/or bet buttons as quickly as possible to pass through the losses to get to another win. Business principles require that most outcomes not be large winning outcomes for the player. Thus, many gambling sessions include extended periods that are devoid of large winning outcomes. Even during a more balanced gaming session, a great portion of time on a gaming device is spent watching reels spin (poker hands played, etc.) with a resulting loss. It is understood that these losses must be balanced with giving the player some incentive to keep playing, and casinos look for ways to maintain player interest in the gaming device besides providing wins.

Gaming machines typically operate with a random number generator (RNG) that generates a numeric code by which to determine a game outcome. For example, a slot machine is often constructed of 3 reels, with a multiplicity of symbols placed on each. Certain combinations of symbols that align on a center payline are designated as winning outcomes and are assigned award amounts. Other outcomes are losing outcomes that generally are not associated with an award. If each reel is equipped with 22 positions, there are 22×22×22 (10,648) possible combinations that can appear on a single payline.

By varying the quantity and value of symbols placed on each reel, a variety of payback percentages are obtainable. To help create more flexibility in generating payback percentages, some games use longer reel strips with more symbols or use virtual reel strips that map one or more possible outcomes to each position on a reel strip. Many games are created with multiple paytables that having varying payback percentages. Casino operators are typically able to select a particular paytable for each game. Thus, casinos in popular locations may choose paytables with lower payback percentages during peak days or hours and select paytables with a higher payback percentage at slower times to entice more gambling. Additionally, casinos in more remote locations may choose paytables with significantly higher payback percentages to attract players to their game floors. Hence, the flexibility afforded by providing multiple paytables in a single game is important for casinos.

However, during creation of games, it is often difficult to obtain the precise payback percentage desired. Adding or removing a single symbol may alter the payback percentage by several percentage points and require significant design and testing time to calculate and verify. These changes in the paytables may also significantly change how a game plays and may frustrate loyal players familiar with a game. For example, to achieve a lower payback percentage, a game designer may have to remove a bonus symbol from a reel and replace it with a minor symbol. This may result in fewer bonus games and more small wins, which changes the volatility and character of the game. Additionally, even if a game device manufacturer comes up with ten different paytables, the casino is limited to these ten paytables only.

DETAILED DESCRIPTION

Figure 1:
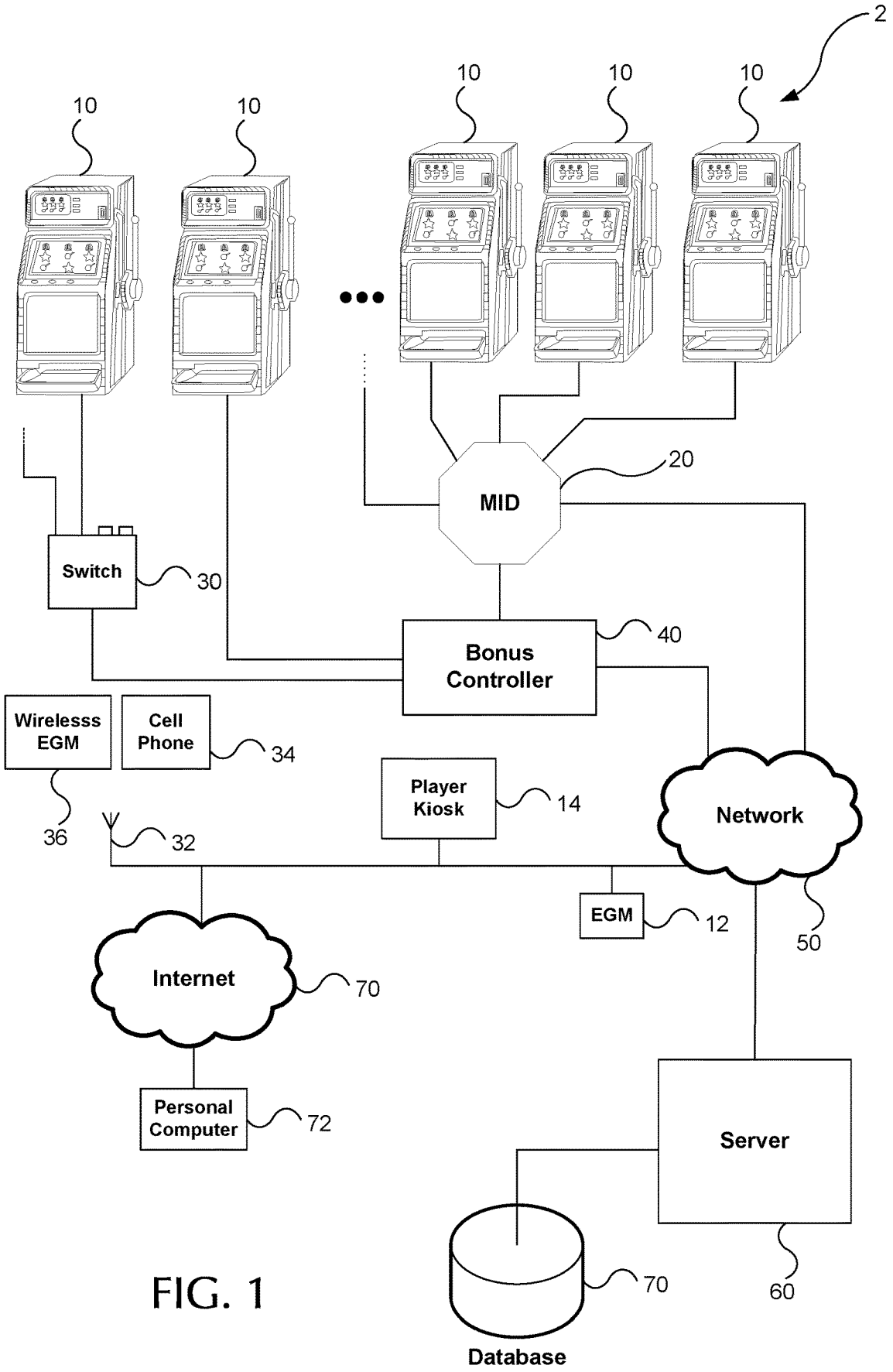
FIG. 1 is a system diagram illustrating various components of a gaming system according to embodiments of the invention.

FIG. 1 is a system diagram illustrating various components of a gaming system according to embodiments of the invention. Referring to FIG. 1, the gaming system 2 includes several gaming devices, also referred to as Electronic Gaming Machines (EGMs) 10 that are connected to a gaming network 50 through various communication mechanisms.

In general, a gaming network 50 connects any of a number of EGMs 10, or other gaming devices, such as those described below, for central management. Accounting and other functions may be served by a connected server 60 and database 70. For example many player tracking functions, bonusing systems, and promotional systems may be centrally administrated from the server 60 and database 70. In some embodiments there may be multiple servers 60 and databases 70, each performing different functions. In other embodiments functions may be combined and operate on a single or small group of servers 60, each with their own database 70 or combined databases.

Many of the EGMs 10 of FIG. 1 connect to the gaming network 50 through a Machine Interface Device, MID 20. In general, the MID 20 is a multi-protocol interface that monitors communication between the gaming network 50 and the EGM 10. In a common embodiment, the MID 20 communicates to the EGM 10 through a standard gaming network port, using a standard gaming network protocol, SAS, which is well known in the gaming industry. Most modern games include at least one communication port, which is commonly a SAS port or a port for another communication protocol. The MID 20, along with its various functions and communication methods is described in detail with reference to FIGS. 3A and 3B below.

Other EGMs 10 in FIG. 1 connect to the gaming network 50 through a bonus controller 40, which may be coupled between the gaming network 50 and gaming device 10. The bonus controller 40 generally communicates through a non-SAS protocol, such as another well-known communication protocol known as GSA. GSA is typically carried over an Ethernet network, and thus the bonus controller 40 includes an Ethernet transceiver, which is described with reference to FIG. 4 below. Because the bonus controller 40 communication may be Ethernet based, a switch 30 may be used to extend the number of devices that may be coupled to the bonus controller 40. The bonus controller 40 and/or the MID 20 may create or convert data or information received according to a particular protocol, such as SAS, into data or information according to another protocol, such as GSA. In this way the MID 20 and bonus controller 40 are equipped to communicate, seamlessly, between any EGM 10 and gaming network 50 no matter which communication protocols are in use. Further, because the MID 20 and bonus controller 40 are programmable, and include multiple extensible communication methods, as described below, they are capable of communicating with EGMs 10 that will communicate using protocols and communication methods developed in the future.

Other games or devices on which games may be played are connected to the gaming network using other connection and/or communication methods. For instance, an EGM 12 may couple directly to the network 50 without any intervening hardware, other than hardware that is built into the EGM 12 to connect it to the network 50. Likewise, a player kiosk 14 may be directly coupled to the gaming network. The player kiosk 14 allows players, managers, or other personnel to access data on the gaming network 50, such as a player tracking record, and/or to perform other functions using the network. For example, a player may be able to check the current holdings of the player account, transfer balances, redeem player points for credits, cash, or other merchandise or coupons, such as food or travel coupons, for instance.

A wireless transceiver 32 couples the gaming network 50 to a wireless EGM 36, such as a handheld device, or, through a cell phone or other compatible data network, the transceiver 32 connects to a cellular phone 34. The cellular phone 34 may be a "smart phone," which in essence is a handheld computer capable of playing games or performing other functions on the gaming network 50, as described in some embodiments of the invention.

The gaming network 50 also couples to the internet 70, which in turn is coupled to a number of computers, such as the personal computer 72 illustrated in FIG. 1. The personal computer 72 may be used much like the kiosk 14, described above, to manage player tracking or other data kept on the gaming network 50. More likely, though, is that the personal computer 72 is used to play actual games in communication with the gaming network 50. Player data related to games and other functions performed on the personal computer 72 may be tracked as if the player were playing on an EGM 10.

In general, in operation, a player inserts a starting credit into one of the games, such as an EGM 10. The EGM 10 sends data through its SAS or other data communication port through the MID 20 and/or bonus controller 50 to the gaming network 50. Various servers 60 and databases 70 collect information about the gameplay on the EGM 10, such as wagers made, results, various pressing of the buttons on the EGM 10, for example. In addition, the SAS port on the EGM 10 may also be coupled, through the MID 20 as described below, to other systems, such as player tracking systems, accounting, and ticketing systems, such as Ticket-In-Ticket-Out (TITO) systems.

In addition, the EGM 10 accepts information from systems external to the EGM itself to cause the EGM 10 to perform other functions. For example, these external systems may drive the EGM 10 to issue additional credits to the player. In another example, a promotional server may direct the EGM 10 to print a promotional coupon on the ticket printer of the EGM.

The bonus controller 40 is structured to perform some of the above-described functions as well. For example, in addition to standard games on the EGM 10, the bonus controller 40 is structured to drive the EGM 10 to pay bonus awards to the player based on any of the factors, or combination of factors, related to the EGM 10, the player playing the EGM 10, particular game outcomes of the game being played, or other factors.

In this manner, the combination of the bonus controller 40 and MID 20 are a sub-system capable of interfacing with each of the EGMs on a gaming network 50. Through this interface, the MID 20 may gather data about the game, gameplay, or player, or other data on the EGM 10, and forward it to the bonus controller 40. The bonus controller 40 then uses such collected data as input and, when certain conditions are met, sends information and/or data to the EGM 10 to cause it to perform certain functions.

In a more detailed example, suppose a player is playing an EGM 10 coupled to the MID 20 and the bonus controller 40 described above. The player inserts a player tracking card so the gaming network 50 knows the player identity. The MID 20 also stores such identifying information, or perhaps stores only information that the player is a level-2 identified player, for instance. The MID 20 passes such information to the bonus controller 40, which has been programmed to provide a welcome-back bonus to any level-2 player after he or she has played two games. Gameplay on the EGM 10 continues and, after the player plays two games, the bonus controller 40 instructs the EGM 10 to add an additional 40 credits to the EGM 10 as the welcome-back bonus. Such monitoring and control of the EGM 10 can occur in conjunction with, but completely separate from any player tracking or bonusing function that is already present on the gaming network 50. In other words, the server 60, when structured at least in part as a bonusing server, may be set to provide a time-based bonus of 10 credits for every hour played by the player of the EGM 10. The above-described welcome-back bonus may be managed completely separately through the bonus controller 40 and MID 20. Further, all of the actions on the EGM 10 caused by the bonus controller 40 are also communicated to the standard accounting, tracking, and other systems already present on the gaming network 50.

Figure 2:
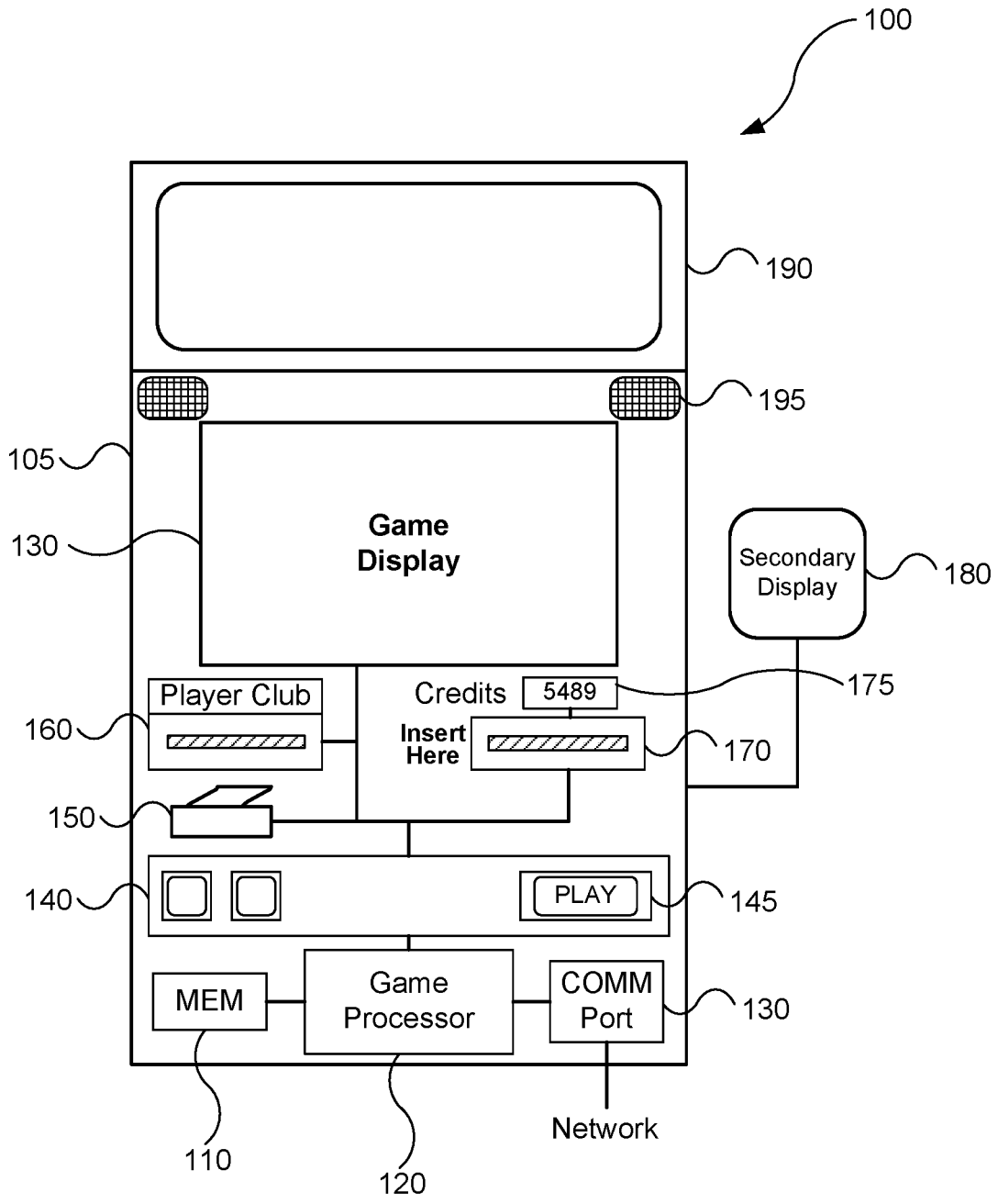
FIG. 2 is a functional block diagram that illustrates an example gaming device that can be a part of the gaming system shown in FIG. 1.

FIG. 2 is a functional block diagram that illustrates an example gaming device that can be a part of the gaming system shown in FIG. 1. Referring to FIG. 2, the illustrated gaming device 100 is an example of the EGMs 10, 12 that are shown in FIG. 1. These EGMs 10, 12 may include all types of electronic gaming machines, such as physical reel slot machines, video slot machines, video poker gaming devices, video blackjack machines, keno games, and any other type of devices may be used to wager monetary-based credits on a game of chance. As mentioned above, various other types of gaming devices may be connected to the network 50 (FIG. 1) such as wireless gaming devices 36, computers used for gaming purposes 72, cellular phones 34, multi-player gaming stations, server-based gaming terminals, etc.

Returning to FIG. 2, the illustrated gaming device 100 includes a cabinet 105 to house various parts of the gaming device 100, thereby allowing certain components to remain securely isolated from player interference, while providing access to player input/output devices so that the player may interact with the gaming device. The securely housed components include the game processor 120, memory 110, and connection port 130. The game processor 120, depending on the type of gaming device 100, may completely or partially control the operation of the gaming device. For example, if the gaming device 100 is a standalone gaming device, game processor 120 may control virtually all of the operations of the gaming device and attached equipment. In other configurations, the game processor 120 may implement instructions generated by or communicated from a remote server (e.g., server 60 shown in FIG. 1) or other controller. For example, the game processor 120 may be responsible for running a base game of the gaming device 100 and executing instructions received over the network 50 from a bonus server or player tracking server. In a server-based gaming environment, the game processor 120 may simply act as a terminal to perform instructions from a remote server that is running game play on the gaming device 100.

The memory 110 is connected to the game processor 120 and may be configured to store various game information about gameplay or player interactions with the gaming device 100. This memory may be volatile (e.g., RAM), non-volatile (e.g., flash memory), or include both types of memory. The connection port 130 is also connected to the game processor 120. This connection port 130 typically connects the gaming device 100 to a gaming network, such as the gaming network 50 described above. The connection port 130 may be structured as a serial port, parallel port, Ethernet port, optical connection, wireless antenna, or any other type of communication port used to transmit and receive data. Although only one connection port 130 is shown in FIG. 1, the gaming device 100 may include multiple connection ports. As described above, in many existing gaming devices, this connection port 130 is a serial connection port utilizing a SAS protocol to communicate to one or more remote game servers, such as player tracking servers, bonus servers, accounting servers, etc.

The player input/output devices housed by the gaming cabinet 105 include a game display 130, a button panel 140 having one or more buttons 145, a ticket printer 150, a bill/ticket reader 170, a credit meter 175, a player club interface device 160, and one or more game speakers 195. Various gaming devices may include fewer or more input/output devices (e.g., a game handle, a coin acceptor, a coin hopper, etc.) depending upon the configuration of the gaming device.

The gaming display 130 may have mechanical spinning reels, a video display, or include a combination of both spinning reels and a video display, or use other methods to display aspects of the gameplay to the player. If the gaming display 130 is a video display, the gaming display may include a touch screen to further allow the player to interact with game indicia, soft buttons, or other displayed objects. The button panel 140 allows the player to select and place wagers on the game of chance, as well as allowing the player to control other aspects of gaming. For example, some gaming devices allow the player to press a button 145 to signal that he or she requires player assistance. Other buttons may bring up a help menu and/or game information. The buttons 145 may also be used to play bonuses or make selections during bonus rounds.

Ticket printers 150 have relatively recently been included on most gaming devices to eliminate the need to restock coin hoppers and allow a player to quickly cash-out credits and transfer those credits to another gaming device. The tickets can also typically be redeemed for cash at a cashier cage or kiosk. The ticket printers are usually connected to the game processor and to a remote server, such as a TITO server to accomplish its intended purpose. In gaming devices that have more than one peripheral device, and which include only a single SAS port, the peripheral devices all share communication time over the connection port 130.

Another peripheral device that often requires communication with a remote server is the player club interface device 160. The player club interface device 160 may include a reader device and one or more input mechanisms. The reader is configured to read an object or indicia identifying the player. The identifying object may be a player club card issued by the casino to a player that includes player information encoded on the card. Once the player is identified by a gaming device, the player club interface device 160 communicates with a remote player server through the connection port 130 to associate a player account with the gaming device 100. This allows various information regarding the player to be communicated between the gaming device 100 and the player server, such as amounts wagered, credits won, and rate of play. In other embodiments, the card reader may read other identifying cards (such as driver licenses, credit cards, etc.) to identify a player. Although FIG. 2 shows the reader as a card reader, other embodiments may include a reader having a biometric scanner, PIN code acceptor, or other methods of identifying a player so as to pair the player with their player tracking account. As is known in the art, it is typically advantageous for a casino to encourage a player to join a player club since this may inspire loyalty to the casino, as well as give the casino information about the player's likes, dislikes, and gaming habits. To compensate the player for joining a player club, the casino often awards player points or other prizes to identified players during game play.

Other input/output devices of the gaming device 100 include a credit meter 175, a bill/ticket acceptor 170, and speakers 195. The credit meter 175 generally indicates the total number of credits remaining on the gaming device 100 that are eligible to be wagered. The credit meter 175 may reflect a monetary unit, such as dollars, or an amount of credits, which are related to a monetary unit, but may be easier to display. For example, one credit may equal one cent so that portion of a dollar won can be displayed as a whole number instead of decimal. The bill/ticket acceptor 170 typically recognizes and validates paper bills and/or printed tickets and causes the game processor 120 to display a corresponding amount on the credit meter 175. The speakers 195 play auditory signals in response to game play or may play enticing sounds while in an "attract-mode," when a player is not at the gaming device. The auditory signals may also convey information about the game, such as by playing a particularly festive sound when a large award is won.

The gaming device 100 may include various other devices to interact with players, such as light configurations, top box displays 190, and secondary displays 180. The top box display 190 may include illuminated artwork to announce a game style, a video display (such as an LCD), a mechanical and/or electrical bonus display (such as a wheel), or other known top box devices. The secondary display 180 may be a vacuum fluorescent display (VFD), a liquid crystal display (LCD), a cathode ray tube (CRT), a plasma screen, or the like. The secondary display 180 may show any combination of primary game information and ancillary information to the player. For example, the secondary display 180 may show player tracking information, secondary bonus information, advertisements, or player selectable game options. The secondary display may be attached to the game cabinet 105 or may be located near the gaming device 100. The secondary display 180 may also be a display that is associated with multiple gaming devices 100, such as a bank-wide bonus meter, or a common display for linked gaming devices.

In operation, typical play on a gaming device 100 commences with a player placing a wager on a game to generate a game outcome. In some games, a player need not interact with the game after placing the wager and initiating the game, while in other games, the player may be prompted to interact with the gaming device 100 during game play. Interaction between the player and the gaming device 100 is more common during bonuses, but may occur as part of the game, such as with video poker. Play may continue on the gaming device 100 until a player decides to cash out or until insufficient credits remain on the credit meter 175 to place a minimum wager for the gaming device.

Communication between gaming devices, such as those described above, and other devices on gaming systems 2 (FIG. 1) is becoming increasingly more complex. The below-described system illustrates a system and method of communication on modern and future gaming systems.

Figure 3A:
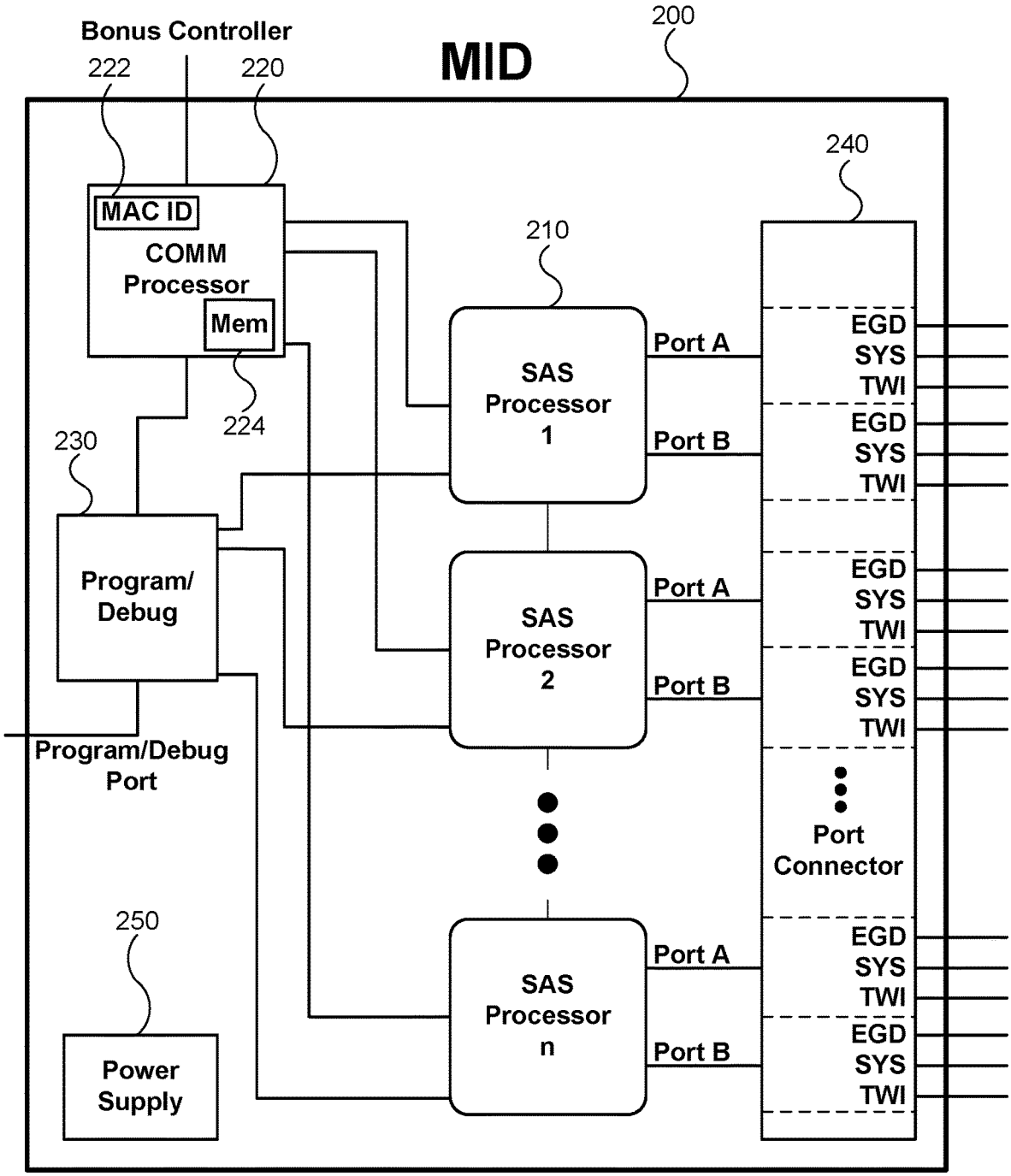
FIG. 3A is a block diagram of an example machine interface device shown in FIG. 1 according to embodiments of the invention.

FIG. 3A is a block diagram of a MID 200, which may be an example of the MID 20 described with reference to FIG. 1 above. The MID 200 includes a set of processors 210, which in this example are termed SAS processors. These SAS processors are capable of accepting, manipulating, and outputting data on a SAS protocol network.

The MID 200 is capable of communicating using other communication protocols as well, as described below. Each processor 210 is structured to couple to two Electronic Gaming Devices (EGDs). EGDs may include, for example, gaming devices such as EGM 10 of FIG. 1, or other electronic gaming devices. In the illustrated embodiment, each SAS processor 210 includes two ports, A and B, each of which may be coupled to an EGD. In turn, the two ports A and B are attached to a set of physical connectors, illustrated here as a single connector 240 for convenience of explanation. Each section of the physical connector 240, delineated by dotted lines, includes three separate pairs of communication lines. Each pair of communication lines is illustrated as a single line—a first serial pair labeled EGD, a second serial pair labeled SYS, and a third communication pair that uses two-wire communication, labeled TWI. Note that each of the ports A and B of the SAS processor 210 includes all three communication pairs. Additionally each of the sections of the physical connector 240 includes wires for a voltage and ground reference, though not depicted in FIG. 3A. In an embodiment of the MID 200 with four SAS processors 210, the physical connector 240 includes up to eight sections, each of which may be embodied by a separate, standard, RJ-45 connector to couple to a matching RJ-45 port in the connected EGM 10, or EGD, as determined by the specific implementation.

As illustrated in FIG. 3A, the first serial pair of Port A couples to EGD. The second serial pair may be coupled to external devices connected to the EGD, as needed. Specifically, some serial data protocols, such as SAS, do not allow EGMs 10 to interface with multiple external devices over a single serial communication path. Such external devices may include, for example, player tracking systems and accounting systems. If a particular EGM 10 is already connected to such a system, and thus its SAS port is "full," the MID 200, and in particular a SAS processor 210, may insert itself "between" the connected system and the EGM 10 by using both of the serial pairs in a particular port of the SAS processor 210 to couple to the EGM 10 and the other connected system, respectively. In operation, the MID 200, through the respective SAS processor 210, passes any information directed from the external device coupled to the SYS communication lines in a particular port to the EGD of the same port, or vice-versa, in real time and without interruption. For example, polls, requests for information, and transmission of information are passed from a connected player tracking system, through the SYS lines of Port A to the serial line EGD of Port A. Only a small communication delay is added using such a communication system, which is well within the tolerance limits of SAS protocol. As a result, both the EGM 10 and external system behave as if the MID 200 were not present.

Further, the third communication pair, a two-wire interface labeled TWI, presents opportunity for expansion to future systems installed on the EGM 10, or a new EGM, so that any data may be communicated between the EGM 10 and the MID 200. The TWI may be connected to card readers, top boxes, ticket dispensers, lighting panels, etc. that are coupled to or work in conjunction with an EGM 10.

Besides simply passing information between communication interfaces, the MID 200 also generates information directly for connected EGDs, which may originate from the MID 200 or from another device as described below. In such a case the SAS processor 210 sends the appropriate data through its appropriate serial line or two-wire interface directly to the desired EGD. Then the EGD may send its own data to its connected peripheral.

Referring back to FIG. 3A, the MID 200 additionally includes a communication processor 220, labeled as COMM processor. The communication processor 220 is coupled to each of the SAS processors 210, a program/debug circuit 230, and to a bonus controller 40 (FIG. 1). In practice, the communication processor 220 may be embodied by a small microprocessor, such as the Atmel ATXMEGA256A3, which is readily available to developers, or any other processor or system capable of performing the desired communication functions.

The communication processor 220 collects and aggregates information from the EGDs that are coupled to each of the SAS processors 210 and sends the aggregated information to the bonus controller 40 of FIG. 1. In some embodiments the communication processor 220 is coupled to the bonus controller 40 through an Ethernet interface. The communication processor is structured to parse information from Ethernet data packets and collect it for use by other systems within the MID 200. Because Ethernet is an addressed protocol, by which messages may be sent to a particular Ethernet address, the communication processor 220 also includes an address of the Ethernet device in a MAC ID 222.

The communication processor 220 may also accept information from the bonus controller 40, or other connected devices, and pass such information to the EGDs coupled to the SAS processors 210. The information may include data, instructions, or commands, for instance.

A memory 224, which may be, for instance Ferroelectric Random Access Memory (FRAM) capable of retaining stored contents for over 10 years may be used by the communication processor for both program and data storage. Of course, other memory technologies may be used instead of or in addition to FRAM.

A program/debug circuit 230 in the MID 200 connects to the communication processor 220 as well as to each of the SAS processors 210. During manufacture of the MID 200, the programming functions of the program/debug circuit 230 load program code to each of the SAS processors 210 as well as the communication processor 220. This initial loading may take place through a program/debug communication port. Further, the program codes stored in each of the SAS processors 210 and the communication processor 230 may be updated through commands and data sent from an external device, such as the bonus controller 40, through the communication processor 220 to the program/debug circuit 230. The program/debug circuit 230 then formats the updated program data for each of the connected SAS processors 210 and communication processor 220, and sends a command to each of the processors to be updated to load the new program code.

Figure 3B:
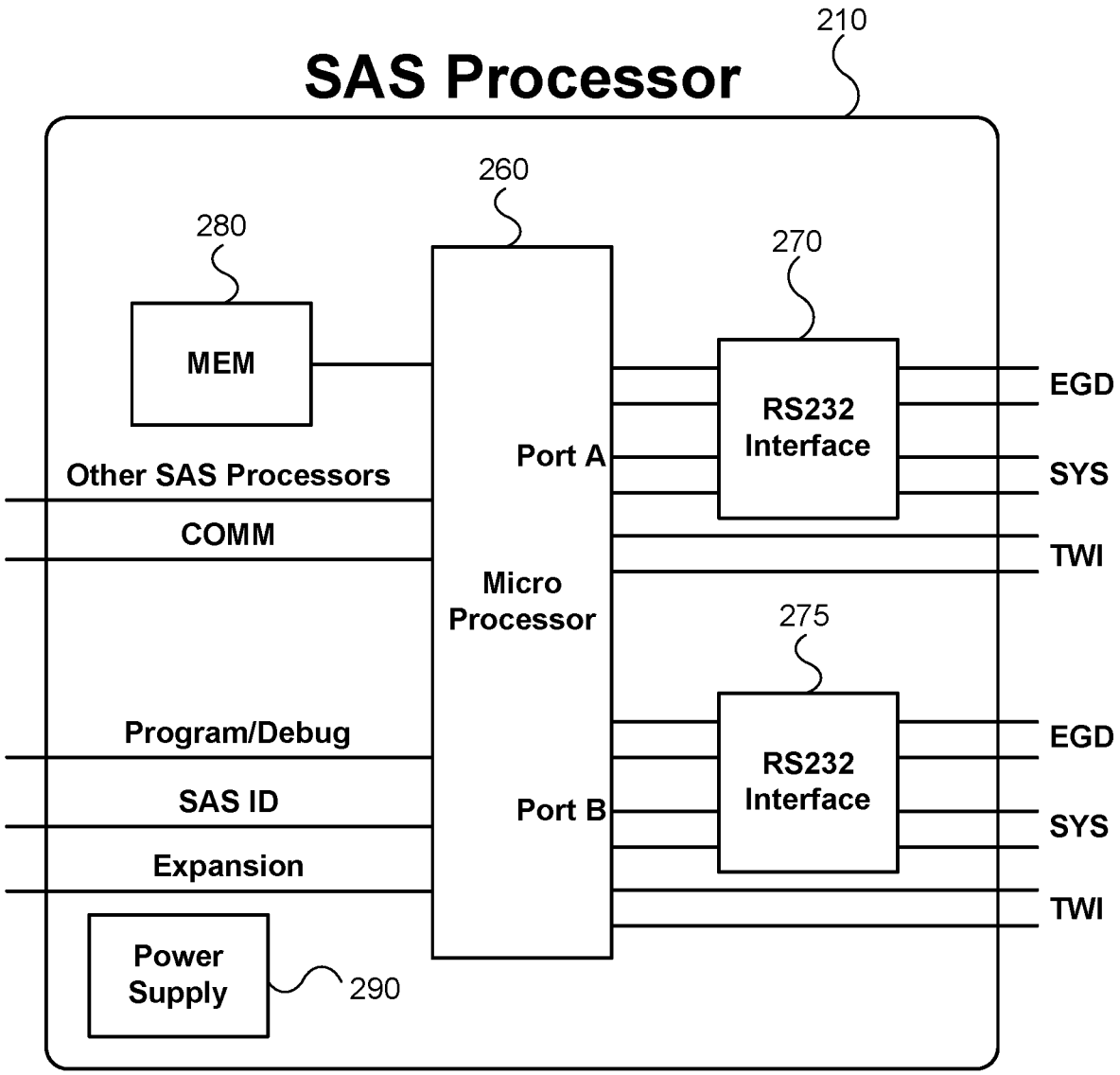
FIG. 3B is a block diagram of an example processor in the machine interface device illustrated in FIG. 3A according to embodiments of the invention.

FIG. 3B is a block diagram of one of the SAS processors 210 of FIG. 3A, which shows additional detail of the SAS processor.

As described above, each of the SAS processors 210 include two separate ports, Port A and Port B, illustrated here as separate ports of a microprocessor 260. The microprocessor 260 in the SAS processor 210 may be embodied by an Atmel ATXMEGA256A3, as described above.

Each of the ports of the microprocessor 260 is structured to couple to an EGD, which may be an EGM 10 of FIG. 1. Each port of the microprocessor 260 includes two serial connections, which in the example embodiment illustrated in FIG. 3B, are RS-232 ports common in the computing industry. The RS-232 ports are contained in an RS-232 interface 270, 275, one for each port of the microprocessor 260. Each of the interfaces 270, 275 includes two separate RS-232 ports, each of which uses a separate transmit and receive wire. Thus, each interface 270, 275 includes a total of four wires. It is convenient to include RS-232 ports as the preferred mode of communication because it is the standard interface for SAS ports of the EGMs 10. In non-standard EGMs 10, such as very old or future devices that may not include SAS ports, communication ports other than RS-232 may be used simply by exchanging or updating the RS-232 interfaces 270, 275. Another possibility is to include an RS-232 translator in any EGM 10 that does not include its own RS-232 interface. As illustrated in FIG. 3B, and as described above, the first of the serial connections, labeled EGD, is connected to an EGD for the particular port of the microprocessor 260, while the second serial connection, labeled SYS is connected to external devices that may be coupled to the particular EGD.

Additionally, and as described above, each SAS processor 210 includes two, two-wire interfaces, illustrated as a separate interface pair and labeled as TWI. In this embodiment, there is one pair for each port of the microprocessor 260. Each two-wire interface creates a bi-directional serial port that may be used for communicating with peripheral or expansion devices associated with the EGD of the particular microprocessor 260, or with other devices on the gaming system 2 of FIG. 1.

The SAS processor 210 includes a memory 280 for storing instruction data of the microprocessor 260 as well as providing data storage used by the SAS processor. The memory 280 is preferably non-volatile memory, such as FRAM that is connected to the microprocessor 260 through a serial interface.

As described above, the SAS processor 210 of the MIB 200 (FIG. 3A) includes multiple connections to other components in the MIB 200, which are illustrated in detail in FIG. 3B. Initially, each SAS processor 210 is coupled to each of the other SAS processors 210 in the MIB 200. In practice, this may accomplished by a direct connection, in which each microprocessor 260 is directly coupled to one another, or such connection may be an indirect connection. In an indirect connection, the microprocessors 260 of each SAS processor 210 is coupled to the communication processor 220 (FIG. 3A). Any data or information to be shared between SAS processors 210 is then originated by or passed through the communication processor 220 to the other SAS processors.

Similarly, as described above, the microprocessor 260 of each SAS processor 210 is coupled to a program/debug circuit 230 for initial or later programming.

To communicate with each SAS processor 210 individually, each SAS processor is given an individual identification number, which may be set for the microprocessor 260 by tying particular data pins of the microprocessor to permanent low or high signals. Using binary encoding, n individual lines are used to identify $2n$ separate processors.

A set of expansion pins couples to the microprocessor 260 of each SAS processor 210 so that each processor may determine system identification and revisions of the MIB 200 and the connected bonus controller 40.

Figure 4:
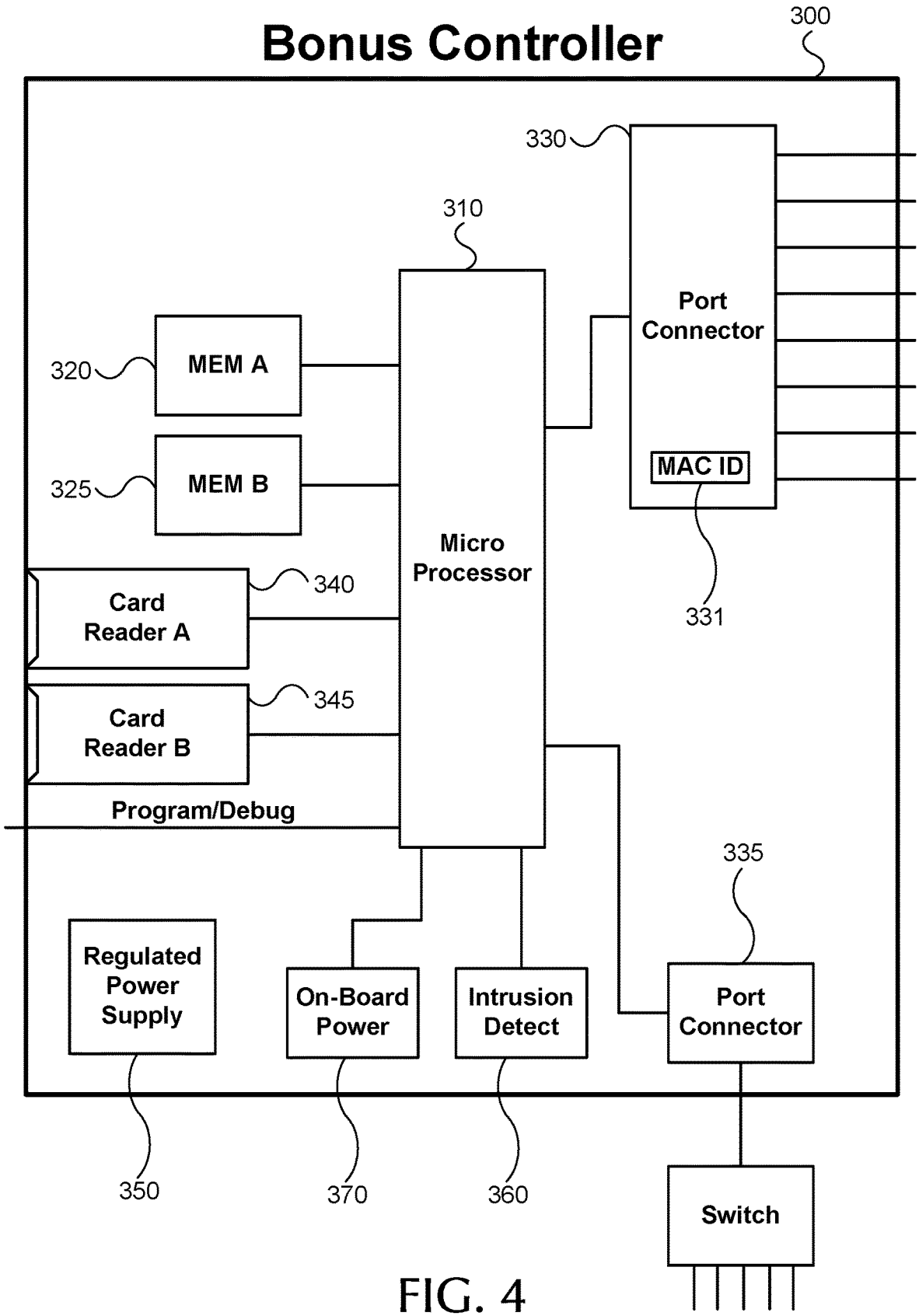
FIG. 4 is a block diagram of an example bonus controller shown in FIG. 1 according to embodiments of the invention.

With reference back to FIG. 1, recall that the bonus controller 40 couples to each of the MIDs 200, and by extension to their coupled EGDs, such as EGMs 10, and possibly to one or more EGMs themselves, to cause data and commands to be sent to the EGMs to control functions on each EGM. FIG. 4 is a detailed block diagram of such a bonus controller, according to embodiments of the invention.

A bonus controller 300 of FIG. 4 may be an embodiment of the bonus controller 40 illustrated in FIG. 1. Central to the bonus controller 300 is a microprocessor 310, which may be an Atmel AT91SAM9G20, which is readily available to developers.

The microprocessor 310 is coupled to one or more memory systems 320, 325. A memory system 320 is a 2 Megabyte FRAM while memory system 325 is a 64 Megabyte Synchronous DRAM (SDRAM). Each memory system 320, 325 has various advantages and properties and is chosen for those properties. FRAM maintains its data autonomously for up to ten years, while SDRAM is relatively fast to move data into and out of, as well as being relatively inexpensive. Of course, the sizes and types of memory included in any bonus controller according to embodiments of the invention may be determined by the particular implementation.

The microprocessor 310 also couples to a pair of card readers, 340, 345, which are structured to accept easily replaceable, portable memory cards, as are widely known. Each card reader may further include Electro-Static Discharge (ESD) devices to prevent damage to internal circuitry, such as the microprocessor 310, when cards are inserted or removed from the card readers 340, 345. In practice, a card in one of the card readers 340, 345 may store program code for the microprocessor 310 while a card in the other reader may store data for use by the bonus controller 300. Alternatively a single card in either of the card readers 340, 345 may store both program and data information.

A port connector 330 includes multiple communication ports for communicating with other devices. With reference back to FIG. 3A, the communication processor of each MID 200 couples to a connected bonus controller through such a communication port. The communication port 330 is preferably an Ethernet interface, as described above, and therefore additionally includes a MAC address 331. The port connector 330 includes multiple separate connectors, such as eight, each of which connect to a single MID 20 (FIG. 1), which in turn connects to up to eight separate EGMs 10. Thus, a single bonus controller 300 may couple to sixty-four separate EGMs by connecting through appropriately connected MIDs.

Further, a second port connector 335 may be included in the bonus controller 300. The second port connector may also be an Ethernet connector. The purpose of the second port connector 335 is to allow additionally connectivity to the bonus controller 300. In most embodiments the second port connector 335 may couple to another bonus controller 300 or to other server devices, such as the server 60 on the gaming network 50 of FIG. 1. In practice, the second port connector 335 may additionally be coupled to a MID 20, thus providing the bonus controller 300 with the ability to directly connect to nine MIDs 20.

Yet further, Ethernet connections are easily replicated with a switch, external to the bonus controller 300 itself, which may be used to greatly expand the number of devices to which the bonus controller 300 may connect.

Because the bonus controller 300 is intended to be present on a gaming network 50, and may be exposed to the general public, systems to protect the integrity of the bonus controller 300 are included. An intrusion detection circuit 360 signals the processor 310 if a cabinet or housing that contains the bonus controller 300 is breached, even if no power is supplied to the bonus controller 300. The intrusion detection circuit may include a magnetic switch that closes (or opens) when a breach occurs. The microprocessor 310 then generates a signal that may be detected on the gaming network 50 indicating that such a breach occurred, so that an appropriate response may be made. An on-board power circuit 370 may provide power to the bonus controller 300 for a relatively long time, such as a day or more, so that any data generated by the processor 310 is preserved and so that the processor 310 may continue to function, even when no external power is applied. The on-board power circuit 370 may include an energy-storing material such as a battery or a large and/or efficient capacitor.

Similar to the microprocessor processor 260 of the SAS processor 210 described above, the microprocessor 310 of the bonus controller 300 is additionally coupled to a program/debug port for initially programming the microprocessor 310 during production, and so that program and/or other data for the microprocessor may be updated through the program/debug port.

In operation the bonus controller 300 configures and controls bonus features on gaming devices through a gaming network 50 or through other communication systems. Bonus features are implemented through each gaming device's internal structure and capabilities, and may include integration with additional peripheral devices. Bonusing programs for the connected games may be introduced to the bonus controller 300 by updating data stored in the memory systems directly on the bonus controller, or by inserting new memory cards in one or more of the card readers 340, 345. Such a platform provides a facility for game developers, even third-party developers, to define and program new types of bonus games that may be used in conjunction with existing EGMs on existing gaming networks, or on new games and new networks as they are developed.

As discussed above, one issue with conventional gaming devices and gaming systems is that they provide a limited number of paytables that are often difficult to generate while attempting to keep the character of a game intact. Embodiments of the present concept provide means to control the payback percentage of games being played on gaming devices without switching paytables or altering properties of a paytable. For purposes of this application, a paytable used for determining a game outcome in the course of traditional game play will be referred to as a "base game paytable." The base game paytable includes both outcomes that are the result of what is generally considered part of the "base game," and also includes outcomes occurring from bonus games, jackpots, or progressive awards that may be awarded to a player during game play. The means for controlling the payback percentage of games is not included in the base game paytable. Rather, it is a mechanism that is independent of the base game paytable.

Base game paytables can be developed and implemented on gaming devices in several ways. For video poker gaming devices, one or more fair 52 card decks are typically used with the variations in pays for specified poker hands being the variables used to alter or control payback percentages of the paytables for the gaming device. In some conventional spinning reel slot machines, the paytable includes a table of symbol combinations and awards associated with each symbol combination. Table 1 below provides an example Paytable for a slot machine game:

TABLE 1

| PAYTABLE | PAY FOR A WAGER OF 10 |
|---|---|
| XX XX CH | 5 |
| AB AB AB | 10 |
| 1B 1B 1B | 20 |
| 2B 2B 2B | 30 |
| 3B 3B 3B | 50 |
| 7 7 7 | 100 |
| JP JP JP | 1000 |

In actual game play, random numbers are used to determine reel stops that correspond to game symbols (or blanks) on the game reels. The gaming device then analyzes the determined reel stops to see if they include a symbol combination that is found on the paytable and is associated with an award. Another method of determining a game outcome is described in co-pending U.S. patent application Ser. No. 12/542,587 entitled DETERMINATION OF GAME RESULT USING RANDOM OVERALL OUTCOME, filed Aug. 17, 2009, the contents of which are incorporated herein. As described in the '587 application, a game may also be determined by using a paytable that includes weighted values for each of the game outcomes. For example, Table 2 below may represent a paytable used to determine a game outcome.

TABLE 2

| Outcome | PAY FOR A WAGER OF 10 | Weight | Hit Freq | Contribution |
|---|---|---|---|---|
| XX XX XX | 0 | 661 | 0.537398 | 0 |
| XX XX CH | 5 | 200 | 0.162602 | 0.81300813 |
| AB AB AB | 10 | 157 | 0.127642 | 1.276422764 |
| 1B 1B 1B | 20 | 100 | 0.081301 | 1.62601626 |
| 2B 2B 2B | 30 | 75 | 0.060976 | 1.829268293 |
| 3B 3B 3B | 50 | 25 | 0.020325 | 1.016260163 |
| 7 7 7 | 100 | 10 | 0.00813 | 0.81300813 |
| JP JP JP | 1000 | 2 | 0.001626 | 1.62601626 |
| Avg. Pay | 9 | 1230 | 100.00% | 9.0000 |
| Avg. Hit Freq | 46.26% | | 46.26% | (90.00%) |

Here, an outcome may be selected by selecting a random number between 0 and 1229. If the selected value is between 0 and 660, the game outcome is a losing game outcome, and a set of reel stops may be selected to show a losing outcome as detailed in the '587 application. If, on the other hand, the selected value is between 661 and 1229, the outcome is a winning game outcome. Here, if the value is between 661 and 860 the game outcome is a Cherry winning outcome with an associated pay of 5 credits. If the selected value is between 861 and 1017 the game outcome is an ANYBAR outcome with an associated award of 10 credits. Similarly, other winning outcomes may be determined to be the winning outcome for other selected values. Again, the actual reel stops to display may be selected according to one of the embodiments discussed in the '587 application.

The above paytable has an overall payback percentage of 90.00%. Embodiments of the present invention allow manipulation of an overall game payback percentage without needing to alter the weights in the above paytable, or create many different fixed percent paytables. Instead, these embodiments allow the payback percentage to be modified up or down without affecting or interfering with this single base game paytable. This, in turn, provides flexibility in altering aspects of game play due to player or gaming conditions.

Figure 5:
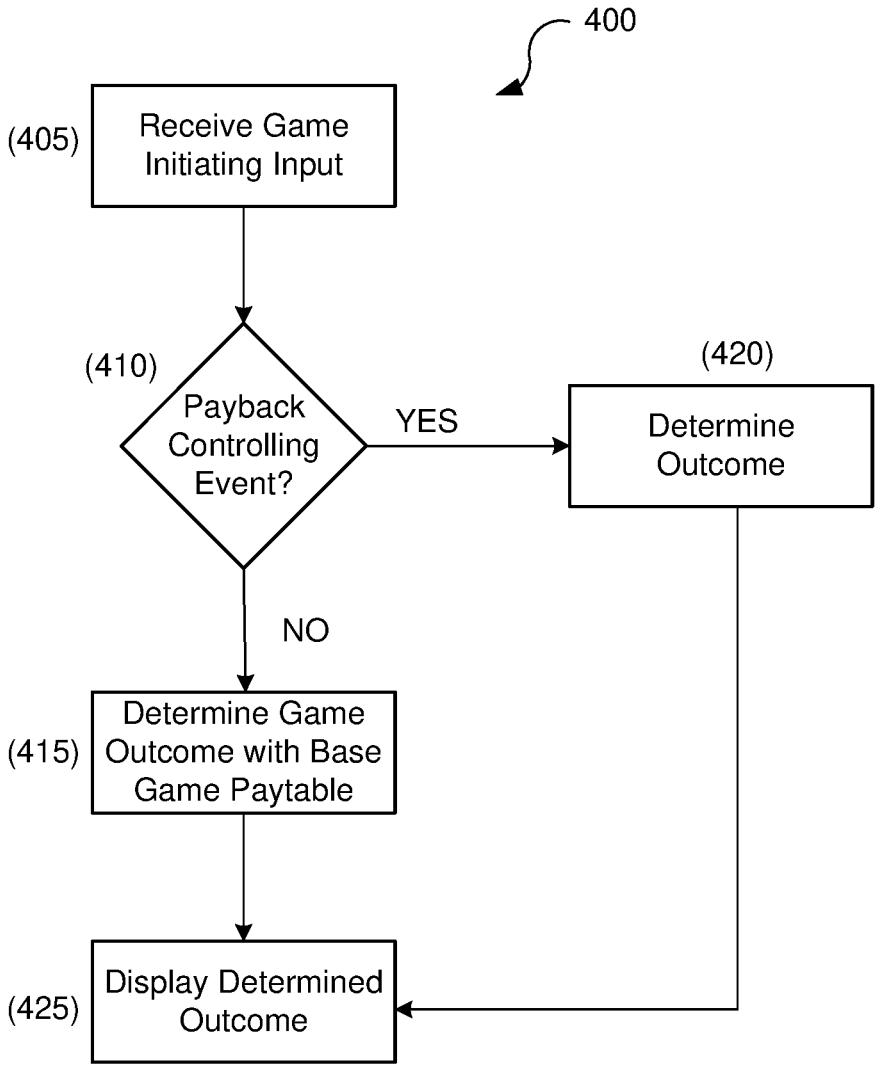
FIG. 5 is a flow diagram of a method of controlling payback percentage on a gaming device according to embodiments of the invention.

To allow this flexibility, the gaming device or gaming system have a payback controlling means. In some embodiments, this payback controlling means includes an inquiry that takes place before a gaming event. If this inquiry indicates that action is to be taken, a payback controlling event is triggered to provide a specific type of game outcome that is not controlled by the base game paytable. FIG. 5 is an exemplary basic method of using the payback controlling means to control the payback percentage of a gaming device. More particularly, FIG. 5 is a flow diagram of a method of controlling payback percentage on a gaming device according to embodiments of the invention.

Referring to FIG. 5, flow 400 begins with process 405 where a game initiating input is received. After the game initiating input is received in process 405, flow 400 proceeds to process 410 to determine if a payback controlling event has been triggered. As mentioned above, the payback controlling event is an event that modifies the overall payback percentage of a base game paytable without manipulating amounts or features within the base game paytable.

If the payback controlling event has not been triggered in process 410, process 400 proceeds to process 415 where a game outcome is determined. Here, the game outcome is determined using the base game paytable. The game outcome may be a winning outcome or losing outcome depending upon the results of the game outcome determination in process 415. If for example, the gaming device is a mechanical three reel slot machine that uses conventional methods for determining a game outcome, a random number generator would indicate numbers associated with specific reel stop positions on each of the three reels and the game processor would determine if this combination of reel stops resulted in a winning combination of symbols appearing on a played payline.

After the game outcome has been determined, the determined outcome is displayed to the player in process 425. This process may include displaying intermediate game action or game steps, such as the spinning and stopping of mechanical or video reels, providing a player the option of holding and drawing cards in video poker, or otherwise displaying portions of game play prior to the display of the ultimate game outcome. If any prizes are associated with the game outcome, they are awarded to the player.

If the payback controlling event has been triggered in process 410, flow 400 proceeds to process 420 where a payback-controlling outcome is determined. Here, various types of game outcomes or game play variations may be used to alter the ultimate average payback percentage of the gaming device. The payback-controlling outcome is then displayed to the player in process 425 using similar methods described above.

One such payback controlling means is a Loss Insertion Mechanism (LIM). A LIM can insert losing or winning outcomes into a typical game session to alter the theoretical payback percent of the gaming device. Although it is referred to as a "Loss" Insertion Mechanism, embodiments of LIMs may be configured to raise a theoretical payback percent of a base game paytable by inserting free spins, credit awards, extra multipliers, or other bonuses mechanisms. These LIMs will be referred to generally as "high LIMs" since they will be raising a theoretical payback percentage of a gaming device. General references to LIMs may include both LIMs that provide losing outcomes and high LIMs, depending sometimes on the context of how it is used.

In one embodiment the LIM is created through software running on a computer such as a microprocessor. In another embodiment the LIM may be implemented in discrete logic, built using programmable logic or through other means. For purposes of this application, the LIM may include any mechanism in a game device or game system that allows for some control of typical game events. In some embodiments, the LIM may be directly implemented in the gaming device to control the payback percent on that gaming device. In other embodiments, the LIM may be implemented into a bonus controller (such as the bonus controller 40 shown in FIG. 1) or other peripheral device connected to the gaming device that allows control over aspects of game play. In yet other embodiments, the LIM may be implemented on a remote server that has at least some control over game play on a connected gaming device.

In one embodiment, the LIM has a single output (TRUE or FALSE) and a single input (True %). The LIM is designed to select an output value that is TRUE for the percentage designated by True %. For example, if True % is set to 75%, the LIM will output a TRUE value 75% of the times it is executed and will output a FALSE value 25% of the times it is executed. The distribution of TRUE outputs may be random or nonrandom.

The LIM may be executed at the start of each game. If the output is TRUE, the normal process for deciding a game outcome is called and the game presents a winning or losing outcome based upon its normal behavior. If the LIM output is FALSE, the normal process for determining a game outcome is bypassed and a losing result is displayed. The losing result may utilize a single outcome presentation or may be selected, either randomly or nonrandomly, from a number of losing outcome presentations. By decreasing the value of True %, the payback % of the game is reduced without altering the existing structure of its game. For example, if True %=90% and the game's payback percentage was 95%, the adjusted payback percentage would become 90%*95%=85.5%.

Effectively, the LIM reduces payback percentage by reducing the frequency of winning outcomes. By creating a LIM capable of accepting precise values of True %, the payback percentage of the game can be adjusted precisely as well. A True % capable of accepting values to a 0.01% tolerance could adjust the payback % to 0.01%*game Payback %. If game Payback %=90%, the overall game payback percentage is then adjusted in steps of 0.01%*90%=0.009% steps.

A game's payback percentage may be adjusted upward by inserting free games, instead of losing outcomes, each time LIM output=TRUE. The free game could automatically execute upon completion of the prior game or the game execution could require player action. Effectively, insertion of free game outcomes increases the frequency of wins during paid games. Examples of these methods are discussed in further detail below with respect to FIG. 8.

There are many alternative ways to construct and operate a LIM to accomplish precise control of payback %. In one embodiment, a separate LIM is utilized with each wager amount allowed on a game. In this way, payback % may vary according to wager amount. For example, a game that allows wagers of 1 to 5 credits, could insert fewer losses on larger wagers than on smaller wagers. In another embodiment, more free game insertions may occur on larger wagers than smaller ones. The same benefit is available to games that accept multiple denominations. For example, a set of LIMs could be configured so that a game that accepts 25 cent, 50 cent and $1 denominations could have fewer losses inserted on high denominations than lower ones or insert more wins on high denominations than lower ones.

LIM systems can be used for both traditional game play, where outcomes are randomly selected for each gaming event that is initiated, or for event list based gaming outcomes where multiple game outcomes are selected prior to receiving game initiating inputs that ultimately correspond to the selected game outcomes. Additional details about event list based gaming are discussed in co-pending application No. 12,981,048, entitled EVENT-BASED GAMING OPERATION FOR GAMING DEVICE that is set out above. In either case, gaming machine operators want to configure overall payback % to match perceived marketing needs. It is difficult to alter weighted paytables and event list contents to account for the quantity and resolution of configuration options desired.

This system addresses that issue by use of Loss Insertions. In one example, a process begins with an event list being completed created from a base game paytable. Weighted paytables are used exactly as before but it is preferred to configure the weighted paytable for a high payback percent, such as 100% payback, or very slightly under (if using a strictly loss inserting embodiments of an LIM). Here, at the start of each game, rather than calling the Event List processor directly, a LIM process is first executed. This LIM process has a single binary output of TRUE or FALSE. It also has the single input called True %, which determines how often the LIM process returns a TRUE outcome as described above. Whenever the output of the LIM process returns a value of TRUE, the Event List Processor is executed exactly as described. However, when the output comes back FALSE, a losing outcome is displayed and the Event List Processor remains undisturbed (i.e., its index does not increment). If the Weighted Paytable/Event List Processor pays 100% and the LIC is set to 95%, the frequency of winning events is reduced by 5% and payback % is effectively reduced to 95%.

As mentioned in the event list application referenced above, one goal of an event list is to create more personalized experiences for players. In some embodiments, each player has their own event list so that the play of others does not trespass on their likelihood of winning. However, the LIM mechanism can be used to further personalize the uniformly created event list by adding losses, free spins, bonuses, or other events. Additionally, the event lists can be manipulated in response to certain gaming conditions, such as the time of day or day of the week. For example, players of Platinum status may have fewer loss insertions and/or more free spin or bonus insertions than do players of Gold status. Further, players visiting during slow times may have fewer loss insertions and/or more free spin or bonus insertions than if the same player visited on New Year's Eve.

In another implementation, a player's win frequency is increased by eliminating loss insertions for a period of time and/or skipping over LOSS outcomes in an event list without charging the player for the game. This latter technique is useful for temporarily converting standard games into tournament games. In tournaments, a player is typically given a fixed number of games, or a fixed duration of play, during which the player accumulates as many credits as possible. These credits are not allowed to be cashed out and are good for no purpose other than establishing a score that is compared against other players. The highest scores usually wins cash prizes. One significant limitation for using traditional gaming devices as tournament games is the difficulty in changing out the pay tables of the game for the brief time a tournament lasts.

In sum, this payback percent controlling means simplifies math calculation, ensures more consistent delivery of awards, provides precise control of payback % and provides differentiated experiences for varying wager sizes, player rankings and time/date of visit.

Figure 6:
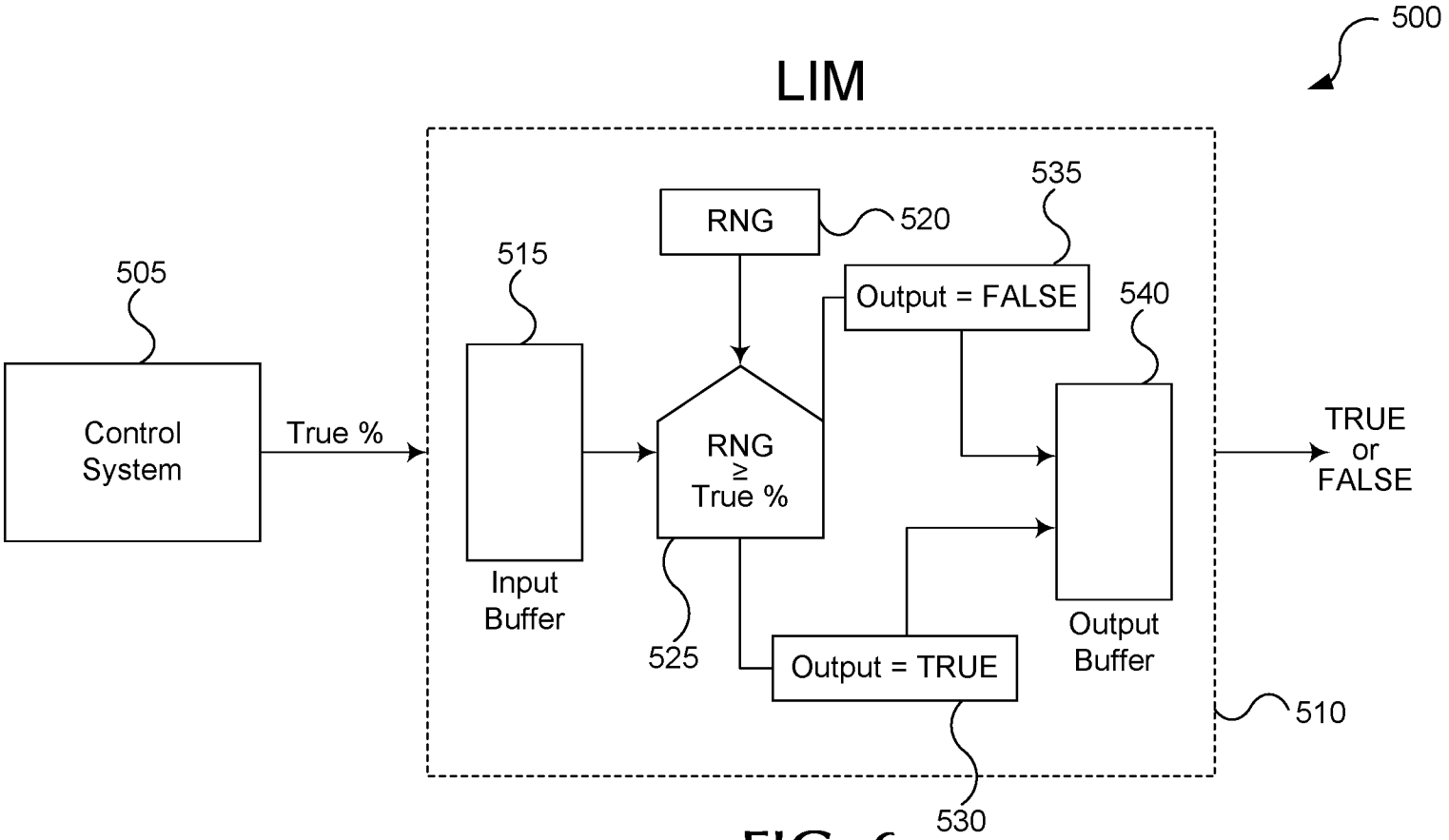
FIG. 6 is a block diagram of an example means for controlling payback percentage on a gaming device according to embodiments of the invention.

FIG. 6 is a block diagram of an example means for controlling payback percentage on a gaming device according to embodiments of the invention.

Referring to FIG. 6, a payback controlling means 500 includes a control system 505 and a payback controlling event device 510. The control system 505 may take inputs from a casino operator or from aspects of the player or game play to output a "True %" value. The payback controlling event device 510 may take the outputted "True %" value and determine if an LIM process is TRUE or FALSE.

Here, the control system 505 may include a display to show a current True % along with a knob, keypad, or other input device to allow an operator to set a True %. Alternatively, the control system 505 may know the percent payback of a base game paytable, allow an operator to input a desired payback percent, and then calculate the True % necessary to reach the operators desired payback percent of the game. In other embodiments, the control system 505 may receive inputs from a game device, player loyalty system, remote server, or other device that provides information about how a particular player or game session should be treated with regard to the payback controlling functions implemented by the payback controlling event device 510. For example, if it is determined that a player is a new player, a high roller, or is otherwise valuable, the control system 505 may prevent payback lowering events from taking place and implementing a high True % value for a high LIM event.

The payback controlling event device 510 may include an input buffer 515 to receive a True % from the control system 505. The payback controlling event device 510 also includes a random number generator (RNG) 520 to generate a random number within a set range and a comparison unit 525 to see if the value generated by the RNG is greater than or equal to the inputted True %. If the RNG value is greater than or equal to the True % value, the value in the output buffer 540 is set to TRUE from an output register or address location 530. If the RNG value is less than the True % value, the value in the output buffer 540 is set to FALSE from an output resister or address location 535. The value in the output buffer 540 is then outputted from the payback controlling event device 510.

Figure 7:
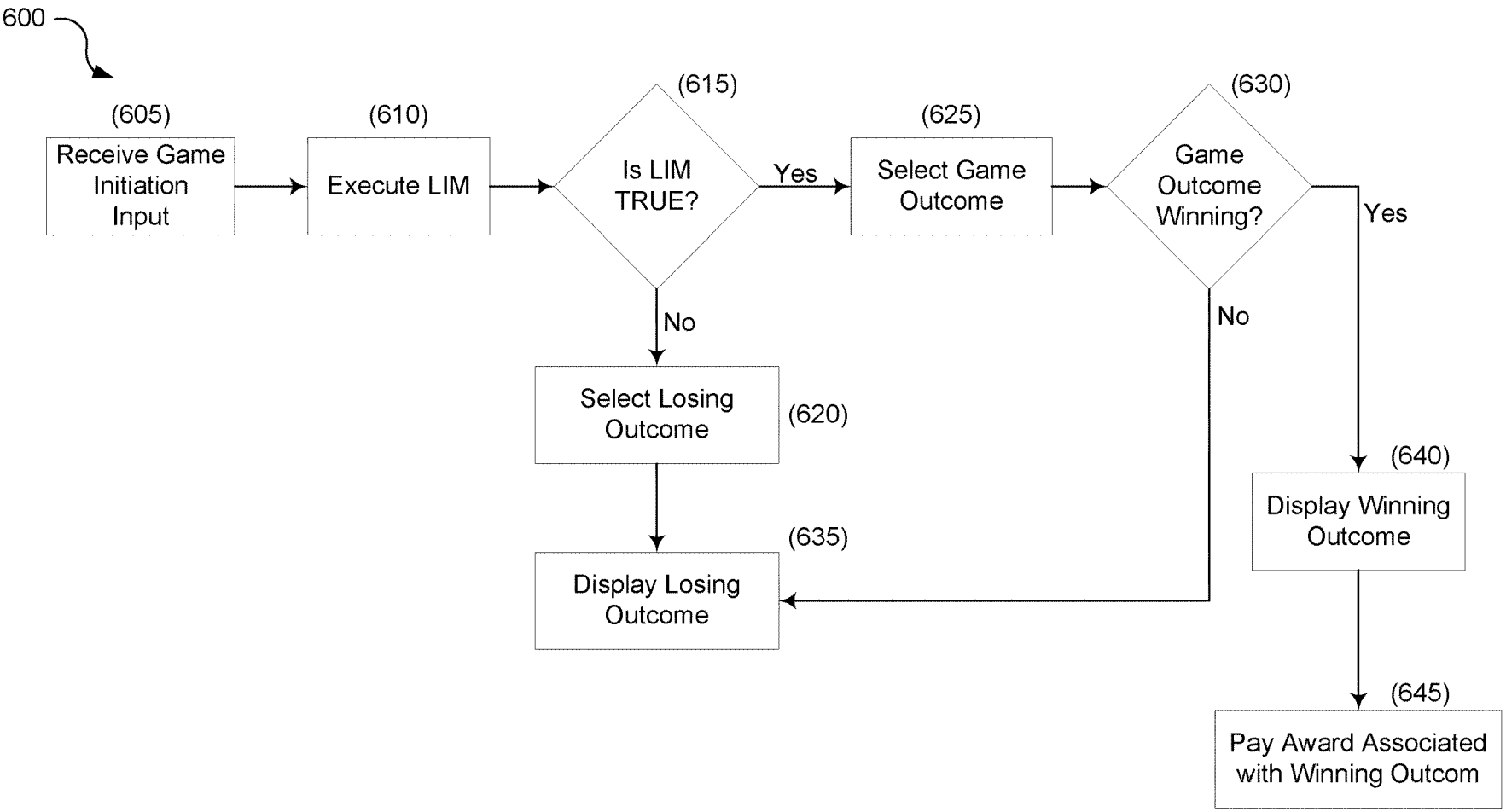
FIG. 7 is a flow diagram of an example method of controlling payback percentage on a gaming device according to embodiments of the invention.

FIG. 7 is a flow diagram of an example method of controlling payback percentage on a gaming device according to embodiments of the invention.

Referring to FIG. 7, flow 600 begins with process 605 where a game initiating input is received. In process 610 a Loss Insertion Mechanism (LIM) process is triggered to generate a TRUE or FALSE outcome. An example LIM process is described above with respect to FIG. 6, where a random number is compared against a predetermined value in a set range to determine what value is outputted by the LIM process. Process 615 is then used to determine a flow path based on the output of the LIM process in process 610.

If it is determined that the value outputted by the LIM process is FALSE, flow 600 moves to process 620 where a losing outcome is selected. Since it is determined that a losing outcome is to be used as a game outcome, process 620 uses a random or scripted process to select the outcome that the player ultimately receives on the game display. For example, process 620 may randomly select reel positions to display, check to see if the random reel positions result in a losing outcome, and repeat the process until a selected outcome is determined to be a losing outcome. Once a losing outcome has been selected in process 620, flow 600 moves to process 635 to display the losing outcome.

If, on the other hand, it is determined that the value outputted by the LIM process is TRUE, flow 600 proceeds to process 625 where a game outcome is determined using the base game paytable. Process 630 is then used to determine if the determined game outcome is a winning or losing game outcome. If the game outcome is a losing game outcome, flow 600 moves to process 635 to display the losing game outcome. If, however, the game outcome is determined to be a winning game outcome, flow 600 instead proceeds to process 640 where the winning game outcome is displayed to the player. Following the display of the winning game outcome, flow 600 moves to process 645 to pay the awards associated with the winning game outcome to the player.

Figure 8:
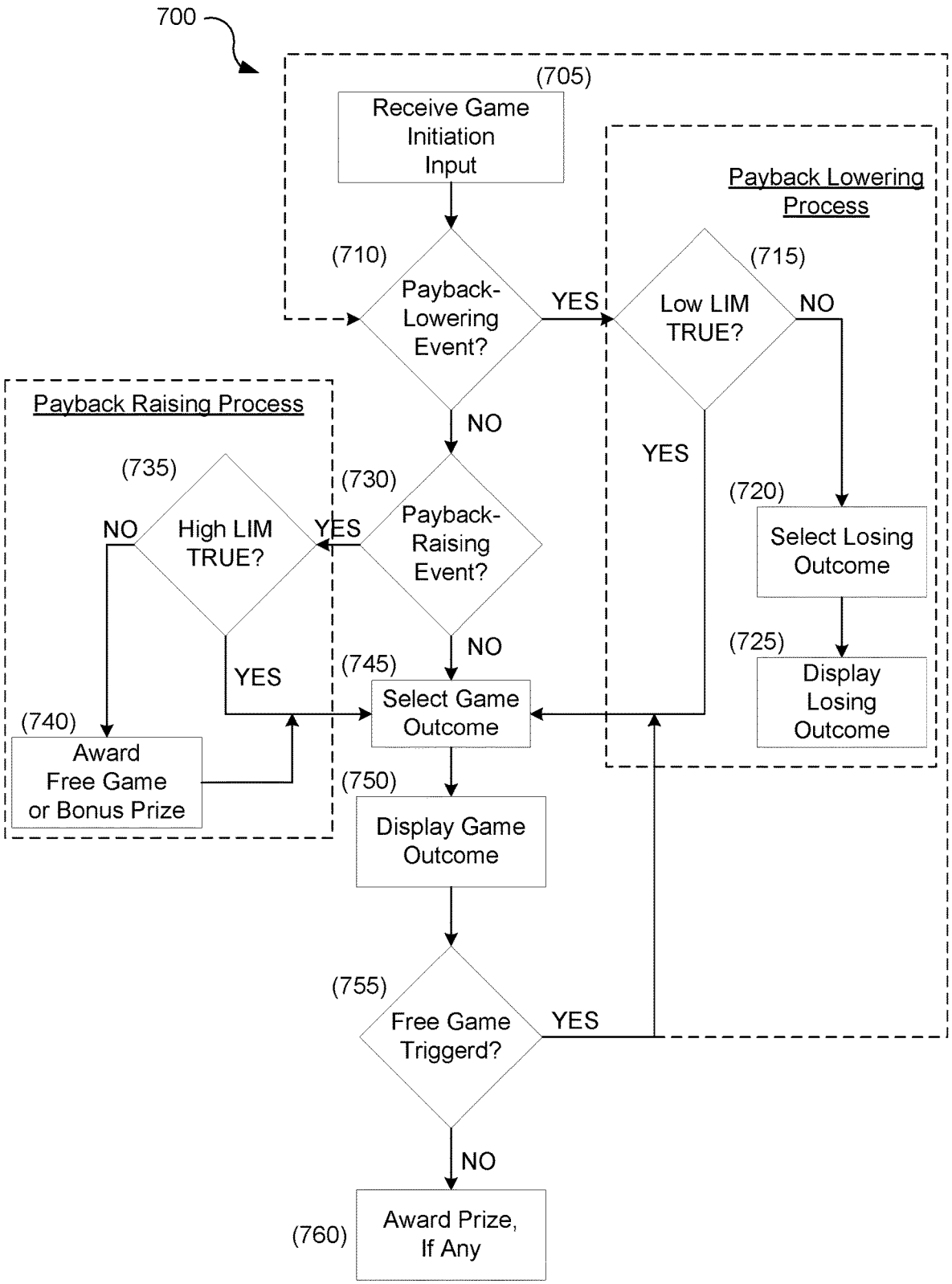
FIG. 8 is a flow diagram of another example method of controlling payback percentage on a gaming device according to embodiments of the invention.

FIG. 8 is a flow diagram of another example method of controlling payback percentage on a gaming device according to embodiments of the invention.

Referring to FIG. 8, flow 700 begins when a game initiating input is received in process 705. After the game initiating input is received, it is determined whether a payback lowering event has taken place in process 710. In some embodiments, process 710 includes an initial inquiry to see if the game device has been configured to allow payback lowering processes to take place. For example, in a tournament style game or in a locals' casino, it may be determined that a payback lowering process is not needed or desirable. Here, if a payback lower process is disabled, flow 700 simply proceeds down to process 730 as there is no possible payback lower event to take place. In other embodiments, it may simply be determined that payback lower process is not needed in for this game event. For example, if it is determined that player is a newly registered player, the payback lowering process may not be activated for that player for their first gaming session to improve their overall theoretical game results. In another example, if a player is placing high value or denomination wagers, the payback lower process may be disabled. In other examples, other criteria may be used to determine whether or not to use payback lowering processes, such as time of day criteria, day of the week criteria, or other criteria. In yet other embodiments, this initial inquiry may not be carried out in process 710 at all. That is, the payback lowering process will be carried out for the game event without any inquiry or question.

If it is determined that payback lowering process is to take place, process 710 continues by triggering a payback-lowering event to generate a TRUE or FALSE outcome and then proceed to a payback lowering process starting with process 715. The payback-lowering event may be similar to the LIM process described above with respect to FIG. 6, where a random number is compared against a predetermined value in a set range to determine what value is outputted by the LIM process. However, other types of triggering processes may be used to determine whether a payback lowering process should be carried out. Process 715 is then used to determine a flow path based on the output of the LIM process in process 710.

If it is determined that the value outputted by the LIM process is FALSE, flow 700 moves to process 720 where a losing outcome is selected. Since it is determined that a losing outcome is to be used as the game outcome, process 720 may use a random or scripted process to select a losing outcome as described above. In process 725 the selected losing outcome is displayed on the game display. If, on the other hand, it is determined that the value outputted by the LIM process is TRUE in process 715, flow 700 proceeds to process 745 where a game outcome is selected using a base game paytable.

If it is determined that a payback lowering process is disabled or otherwise not needed in process 710, flow 700 proceeds to process 730 where it is determined if a payback raising process is to be carried out. Similar to process 710 described above, process 730 may initially determine if a payback raising process is activated or needed. This may again depend on a variety of factors such as player rating, time of day, day of the week, etc. If it is determined that payback raising process is to take place, process 730 continues by triggering a payback-raising event to generate a TRUE or FALSE outcome and then proceed to a payback raising process starting with process 735. The payback-raising event may be similar to the payback lowering event discussed above, such as, for example, having a random number compared against a predetermined value in a set range to determine what value is outputted by the High LIM process. Process 735 is then used to determine a flow path based on the output of the High LIM process in process 730.

Here, if it is determined that the value outputted by the High LIM process is FALSE, flow 700 moves to process 740 where a free game, bonus credit value, or other bonus is indicated as being won by the player. As described above, this bonus award may be immediately shown to the player, or the game outcome may be selected and displayed prior to revealing the bonus awarded in process 740. In either case, after the bonus award is at least determined, flow 700 proceeds to process 745 to select a game outcome. If, on the other hand, it is determined that the value outputted by the High LIM process is TRUE in process 713, flow 700 proceeds to process 745 where a game outcome is selected using a base game paytable.

If it is determined that a payback raising process is disabled or otherwise not needed in process 730, flow 700 proceeds to process 745 where a game outcome is determined using a base game paytable. The selected game outcome is displayed to the player in process 750. Process 755 may inquire to see if a free game or games has been awarded to the player in a payback raising process. If no free games or spins has been awarded to the player in the previous game event, flow 700 proceeds to process 760, where any award associated with the game outcome are given to the player. If it is determined that a free game or spin had been awarded in process 755, flow 700 would proceed to either process 745 to select another game outcome, or to process 710 to check again for payback lowering events and payback raising events prior to selecting a game outcome for the free game or spin.

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A non-transitory computer readable medium that stores a plurality of instructions, which when executed by at least one processor causes the at least one processor to:

randomly select a first value within a first defined range;

compare the selected first value with at least one first defined criterion;

indicate a first result when the selected first value satisfies the first defined criterion;

indicate a second result when the selected first value does not satisfy the first defined criterion;

determine a losing outcome for a game when the first result is indicated;

randomly select one of a plurality of winning and losing game-play outcomes indicated by a paytable for the game when the second result is indicated;

randomly select a second value within a second defined range;

compare the selected second value with at least one second defined criterion;

indicate a third result when the selected second value satisfies the second defined criterion;

indicate a fourth result when the selected second value does not satisfy the second defined criterion;

determine an award that is not based on the paytable when the third result is indicated;

randomly select one of a plurality of winning and losing game-play outcomes indicated by the game paytable when the fourth result is indicated;

use the same paytable without altering the weights or payback percentage of the paytable; and vary at least one of the first or second defined criterion in response to an input selected by an operator of the gaming device.

2. The non transitory computer readable medium of claim 1 wherein the plurality of instructions, when executed by the at least one processor, further causes the at least one processor to determine the losing game outcome via a nonrandom process.

3. The non-transitory computer readable medium of claim 1 wherein the plurality of instructions, when executed by the at least one processor, further causes the at least one processor to determine the losing game outcome by repeatedly selecting outcomes from the game paytable until a losing game outcome is selected.

4. The non transitory computer readable medium of claim 1 wherein the input selected by the operator of the gaming device is derived from a player loyalty system.

5. The non-transitory computer readable medium of claim 1 wherein the input selected by the operator of the gaming device is a function of the amount wagered.

6. A non-transitory computer readable medium that stores a plurality of instructions, which when executed by at least one processor causes the at least one processor to:

if a payback-lowering event in a game has taken place:

randomly select a value within a defined range compare the selected value with a defined criterion;

indicate a first result when the selected value satisfies the defined criterion;

indicate a second result when the selected value does not satisfy the defined criterion;

select a losing game-play outcome when the first process generates the first result;

randomly select one of a plurality of winning and losing game-play outcomes using a base game paytable that includes a plurality of winning and losing game-play outcomes when the first process generates the second result;

display the selected game-play outcome;

distribute awards, if any, associated with the selected game-play outcome;

if a payback-raising event in a game has taken place:

randomly select a value within a defined range;

comparing the selected value with a defined criterion;

indicate a third result when the selected valued satisfies the defined criterion; and indicate a fourth result when the selected value does not satisfy the defined criterion;

award at least one of a free game and a bonus when the second process generates the third result;

randomly select one of a plurality of winning and losing game-play outcomes using a base game paytable that includes the plurality of winning and losing game-play outcomes when the second process generates the third and fourth result;

display the selected game-play outcome;

use the same base game paytable without altering the weights or payback percentage of the base game paytable; and distribute awards, if any, associated with the selected game-play outcome.

7. The method of claim 6, wherein selecting a losing game-play outcome when the first process generates the first result includes:

randomly selecting a game-play outcome;

determining if the selected game-play outcome is a losing outcome; and repeating the random selection and determination processes when a losing game-play outcome is not selected.

8. The non transitory computer readable medium of claim 7 wherein the plurality of instructions, when executed by the at least one processor, further causes the at least one processor to performing the method for each play of the game.

9. The non transitory computer readable medium of claim 6 wherein the plurality of instructions, when executed by the at least one processor, further causes the at least one processor to:

initiate the first process a plurality of times;

generate a corresponding plurality of results; and generate the first result for a determined percentage of the plurality of results.

10. The non-transitory computer readable medium of claim 6 wherein the plurality of instructions, when executed by the at least one processor, further causes the at least one processor to perform the method for each play of the game.

11. The non transitory computer readable medium of claim 6 wherein the plurality of winning and losing game-play outcomes each correspond to a defined number of symbols regardless of the value of the defined criterion in the payback-raising event.

12. The non-transitory computer readable medium of claim 6 wherein the plurality of winning and losing game-play outcomes each comprise a defined number of symbols regardless of the value of the defined criterion in the payback-lowering event.

* * * * *